US007730954B2

(12) United States Patent
Schultz et al.

(10) Patent No.: US 7,730,954 B2
(45) Date of Patent: Jun. 8, 2010

(54) HYDRAULIC CONTROL AND ACTUATION SYSTEM FOR DOWNHOLE TOOLS

(75) Inventors: Roger L. Schultz, Aubrey, TX (US); Melissa G. Allin, Comanche, OK (US); Paul D. Ringgenberg, Frisco, TX (US); Vincent P. Zeller, Flower Mound, TX (US); Tyler T. Trinh, Euless, TX (US); Adam D. Wright, Dallas, TX (US); Donald G. Kyle, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 696 days.

(21) Appl. No.: 11/550,685

(22) Filed: Oct. 18, 2006

(65) Prior Publication Data

US 2007/0079968 A1 Apr. 12, 2007

Related U.S. Application Data

(63) Continuation of application No. 10/438,793, filed on May 15, 2003, now Pat. No. 7,201,230.

(51) Int. Cl.
*E21B 34/12* (2006.01)

(52) U.S. Cl. ..... 166/373; 166/66.7; 166/319; 166/386; 166/332.3

(58) Field of Classification Search ..... 166/373, 166/53, 66.7, 319, 334.1, 386, 332.3

See application file for complete search history.

(56) References Cited

U.S. PATENT DOCUMENTS

| | | | |
|---|---|---|---|
| 3,092,135 | A | 6/1963 | Brown |
| 3,533,430 | A | 10/1970 | Fredd |
| 4,059,157 | A | 11/1977 | Crowe |
| 4,421,174 | A | 12/1983 | McStravick et al. |
| 4,633,952 | A | 1/1987 | Ringgenberg |
| 4,922,423 | A | 5/1990 | Koomey et al. |
| 4,986,357 | A | 1/1991 | Pringle |
| 5,050,681 | A | 9/1991 | Skinner |
| 5,101,907 | A | 4/1992 | Schultz |

(Continued)

FOREIGN PATENT DOCUMENTS

EP 0500341 8/1992

(Continued)

OTHER PUBLICATIONS

Examination report for GB 0609150.8 dated Jun. 5, 2007.

(Continued)

*Primary Examiner*—Kenneth Thompson
(74) *Attorney, Agent, or Firm*—Marlin R. Smith

(57) ABSTRACT

A hydraulic control and actuation system for downhole tools. In a described embodiment, a hydraulic control and actuation system includes an internal chamber serving as a low pressure region and a well annulus serving as an energy source. A valve assembly provides selective fluid communication between alternating opposite sides of a piston and each of the energy source and low pressure region. Displacement of the piston operates a well tool. Operation of the valve assembly is controlled via telemetry between a remote location and an electronic circuit of the system.

25 Claims, 24 Drawing Sheets

U.S. PATENT DOCUMENTS

| | | | |
|---|---|---|---|
| 5,127,477 | A | 7/1992 | Schultz |
| 5,234,057 | A | 8/1993 | Schultz |
| 5,238,018 | A | 8/1993 | Hashida |
| 5,238,070 | A | 8/1993 | Schultz |
| 5,251,703 | A | 10/1993 | Skinner |
| 5,273,113 | A | 12/1993 | Schultz |
| 5,412,568 | A | 5/1995 | Schultz |
| 5,890,542 | A | 4/1999 | Ringgenberg |
| 6,450,258 | B2 | 9/2002 | Green |
| 6,536,530 | B2 | 3/2003 | Schultz et al. |
| 7,111,675 | B2 | 9/2006 | Zisk |
| 7,201,230 | B2 | 4/2007 | Schultz et al. |
| 2004/0226720 | A1 | 11/2004 | Schultz |

FOREIGN PATENT DOCUMENTS

| | | |
|---|---|---|
| EP | 0500343 | 8/1992 |
| EP | 0604156 | 6/1994 |
| WO | WO 03021075 | 3/2003 |

OTHER PUBLICATIONS

Examination report dated Aug. 31, 2006 for UK application No. GB0410709.0.
Office Action for U.S. Appl. No. 10/438,793 dated Jun. 22, 2006.
Office Action for U.S. Appl. No. 10/438,793 dated Mar. 24, 2005.
Office Action for U.S. Appl. No. 10/438,793 dated Feb. 25, 2005.
Office Action issued Jan. 6, 2009, for U.S. Appl. No. 11/199,093, 6 pages.

HYDRAULIC CONTROL AND ACTUATION SYSTEM FOR DOWNHOLE TOOLS

CROSS-REFERENCE TO RELATED APPLICATION

The present application is a continuation of application Ser. No. 10/438,793, filed May 15, 2003 and issued Apr. 10, 2007 as U.S. Pat. No. 7,201,230. The entire disclosure of this prior application is incorporated herein by this reference.

BACKGROUND

The present invention relates generally to operations performed and equipment utilized in conjunction with a subterranean well and, in an embodiment described herein, more particularly provides a hydraulic control and actuation system for downhole tools.

A need exists in the art for improved hydraulic control and actuation systems. In particular, such systems should be remotely controllable so that operational commands may be transmitted from a remote location, such as the earth's surface, to the downhole system, and data may be transmitted from the downhole system to the remote location.

Accordingly, it is an object of the present invention to provide an improved hydraulic control and actuation system for downhole tools. It is a further object of the present invention to provide the system which is remotely communicable with a remote location for transmission of commands and data.

SUMMARY

In carrying out the principles of the present invention, in accordance with an embodiment thereof, a hydraulic control and actuation system for downhole tools is provided.

In one aspect of the invention, a hydraulic control and actuation system for a downhole tool is provided which includes an energy source, a housing assembly having an internal chamber serving as a relatively low pressure region, an actuator assembly including a piston, and a valve assembly including a valve member. The tool operates in response to displacement of the piston. The valve member is displaceable to bias the piston in opposite directions by a pressure differential between the energy source and low pressure region.

In another aspect of the invention, a hydraulic control and actuation system for a downhole tool is provided which includes a valve member that moves to provide fluid communication to alternating sides of a piston, therefore alternating one side being connected to the energy source and the opposite to the low pressure region. Multiple ports provide fluid communication between the valve member and the high energy and low pressure regions. At least one seal is carried on the valve member, but no seal carried on the valve member is exposed to pressure from the energy source while crossing one of the ports which is in fluid communication with the low pressure region.

In a further aspect of the invention, a hydraulic control and actuation system for a downhole tool is provided which includes a housing assembly and an actuator assembly. A piston of the actuator assembly is positioned within the housing assembly. The tool operates in response to displacement of the piston relative to the housing assembly. The piston has an effective piston area which changes during displacement of the piston.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
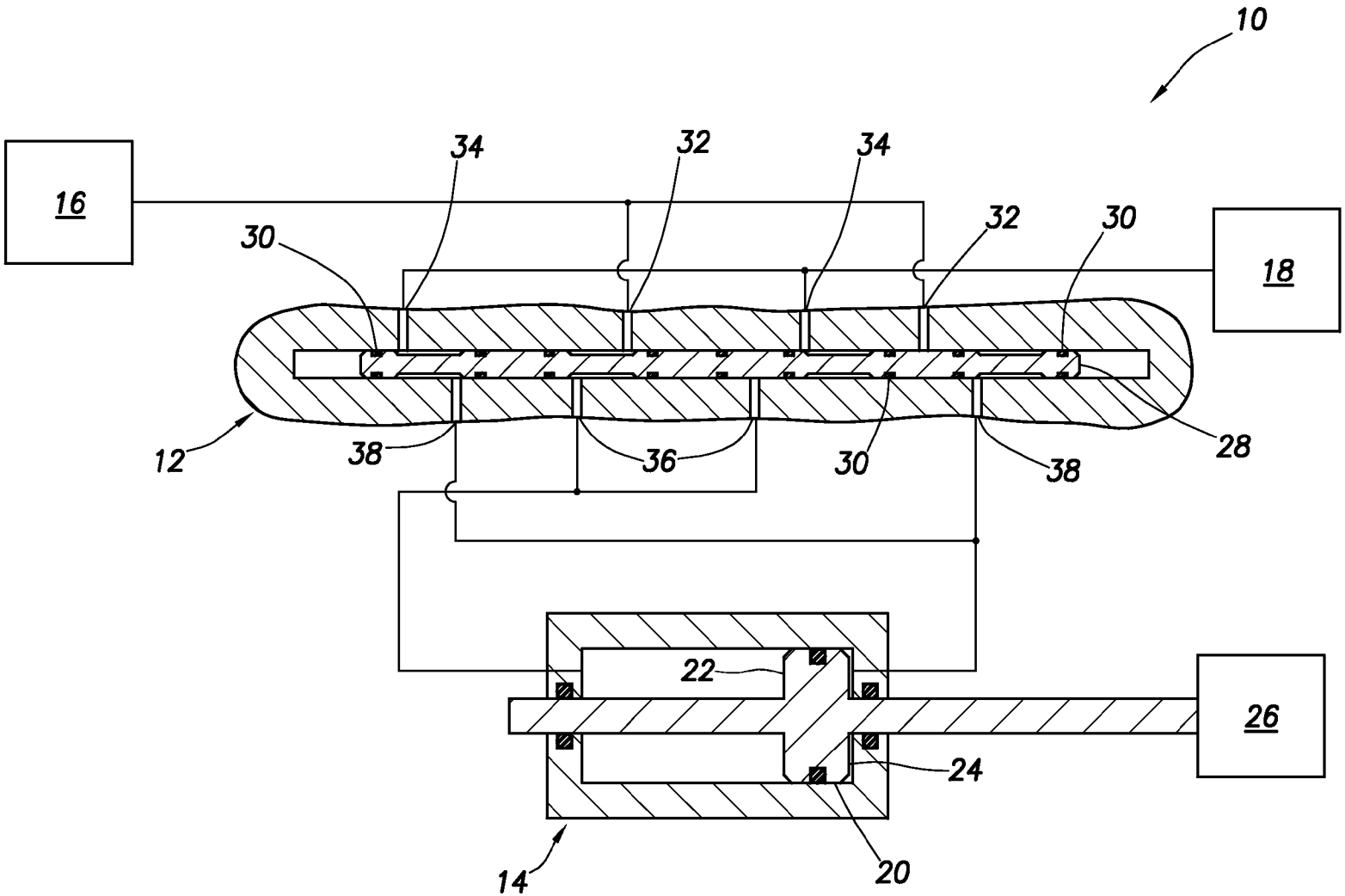
FIGS. 1 & 2 are schematic views of a hydraulic actuation system embodying principles of the present invention.
Figure 2:
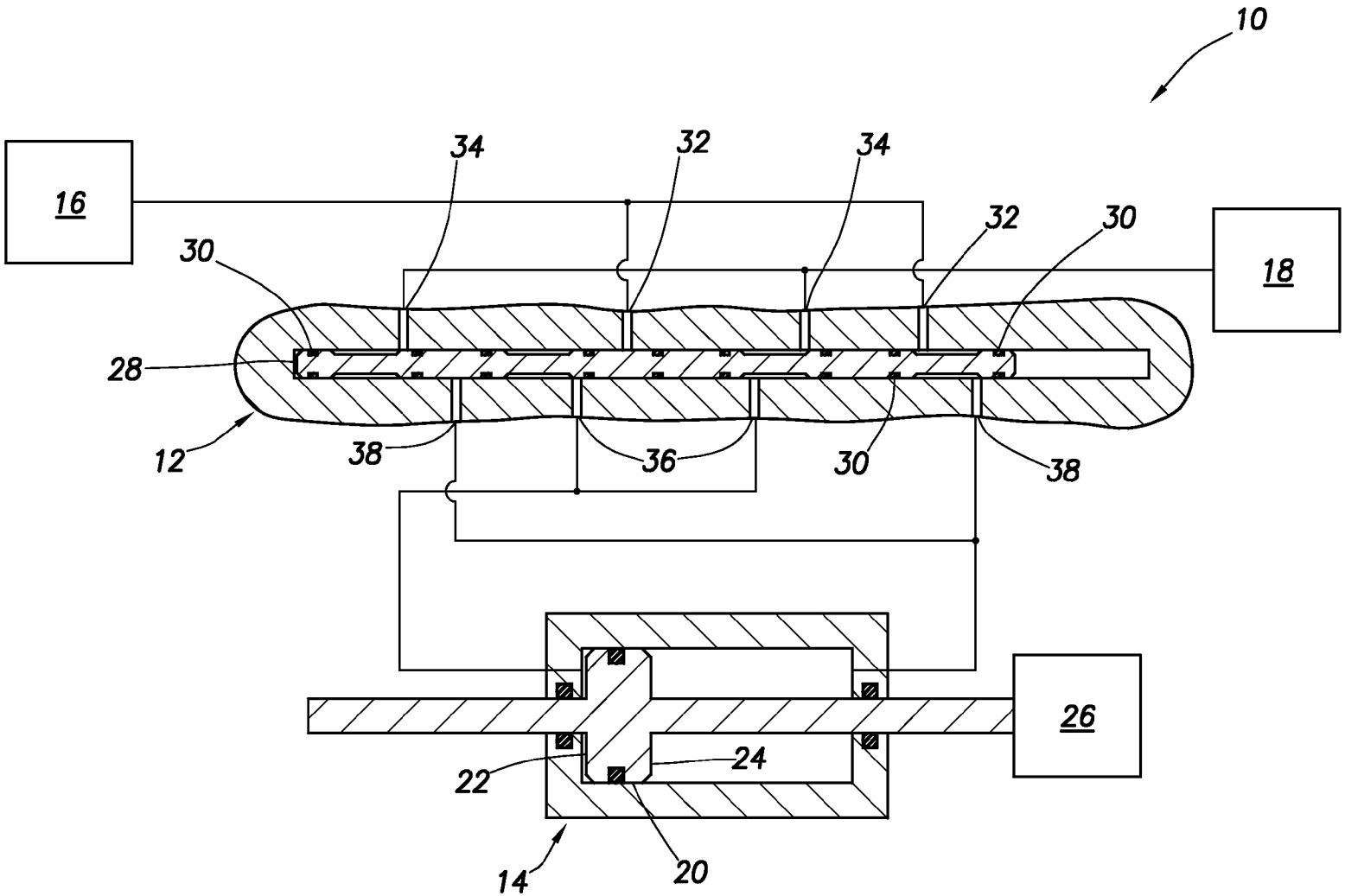

Representatively illustrated in FIGS. 1 & 2 is a hydraulic control and actuation system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The system 10 includes a valve assembly 12 interconnected between an actuator assembly 14 and energy source 16 (representatively, a relatively high pressure source) and low pressure region 18 (representatively, having a pressure less than that of the high pressure source). The actuator assembly 14 includes a piston 20 having opposite sides 22, 24. Displacement of the piston 20 is used in the system 10 to operate a downhole well tool 26, such as a sliding sleeve valve, a choke, a ball valve, a firing head, a packer, or any other type of well tool. For example, displacement of the piston 20 may be used to open or close a valve, adjust a flow rate through a choke, actuate a firing head, set a packer, etc.

The valve assembly 12 includes a valve member depicted in FIGS. 1 & 2 as a shuttle 28 which carries seals 30 thereon. The shuttle 28 displaces between the positions shown in FIGS. 1 & 2 in order to provide fluid communication between the energy source 16 and low pressure region 18 and alternating ones of the piston sides 22, 24. That is, pressure from the energy source 16 is communicated to one of the piston sides 22 while the low pressure region 18 is communicated to the other piston side 24 (as depicted in FIG. 1), and pressure from the energy source is communicated to the piston side 24 while pressure from the low pressure region 18 is communicated to the piston side 22 (as depicted in FIG. 2).

Due to the pressure differential between the energy source 16 and low pressure region 18, the piston 20 is biased to displace in opposite directions, the direction depending upon whether the valve shuttle 28 is in its position as shown in FIG. 1, or in its position as shown in FIG. 2. In FIG. 1, the piston 20 has displaced to the right, since the energy source 16 is in communication with the left side 22 of the piston and the low pressure region 18 is in communication with the right side 24 of the piston. In FIG. 2, the piston 20 has displaced to the left, since the energy source 16 is in communication with the right side 22 of the piston and the low pressure region 18 is in communication with the left side 24 of the piston.

The energy source 16 is in communication with the valve shuttle 28 via ports 32 in the valve assembly 12. The low pressure region 18 is in communication with the valve shuttle 28 via ports 34. The left side 22 of the piston 20 is in fluid communication with the valve shuttle 28 via ports 36. The right side 24 of the piston 20 is in fluid communication with the valve shuttle 28 via ports 38.

As viewed in FIG. 1, one of the ports 32 is in communication with one of the ports 36, and one of the ports 34 is in communication with one of the ports 38. As viewed in FIG. 2, one of the ports 32 is in communication with one of the ports 38, and one of the ports 34 is in communication with one of the ports 36. In this manner, pressures from the energy source 16 and low pressure region 18 are applied to the sides 22, 24 of the piston 20 alternately, to thereby alternately bias the piston to the right or to the left as desired.

A special configuration of the valve assembly 12 helps to prevent damage to the seals 30. Note that none of the seals 30 crosses a low pressure port 34 while the seal is exposed to pressure from the energy source 16. This prevents the seals 30 from being lifted relative to the valve shuttle 28 while the seals cross the low pressure ports 34. Furthermore, the energy source 16 and low pressure region 18 remain isolated from each other as the shuttle 28 displaces between its FIG. 1 and its FIG. 2 positions.

Preferably, the energy source 16 is well pressure, for example, in an annulus or other portion of a well. The low pressure region 18 is preferably an internal chamber of the system 10, for example, conveyed into a well and having a pressure less than well pressure. However, it should be understood that other pressure sources may be used instead of, or in addition to, these pressure sources 16, 18.

For example, a compressed gas, such as nitrogen, well reservoir pressure, a biasing device, such as a spring, a battery, etc. may be used to provide energy for displacing the shuttle 28. Alternatively, or in addition, the energy source 16 may include a compressed gas, such as nitrogen, well reservoir pressure, a biasing device, such as a spring, a battery, etc. to provide or enhance fluid pressure available to the valve assembly 12

Note that fluid is transferred to the low pressure region 18 when the piston 20 displaces from its FIG. 1 position to its FIG. 2 position. This is due to the fact that, as the piston 20 displaces to the left, fluid is transferred from the actuator assembly 14 to the low pressure region 18 via the valve assembly 12 (the valve shuttle 28 permitting flow from one of the ports 36 to one of the ports 34).

In addition, fluid is admitted to the low pressure region 18 when the piston 20 displaces in the opposite direction, from its FIG. 2 position to its FIG. 1 position. This is due to the fact that, as the piston 20 displaces to the right, fluid is transferred from the actuator assembly 14 to the low pressure region 18 via the valve assembly 12 (the valve shuttle 28 permitting flow from one of the ports 38 to one of the ports 34). Thus, whether the piston 20 displaces to the right or to the left, fluid is transferred into the low pressure region 18.

It will be readily appreciated that, if a limited volume of fluid is available in the energy source 16 for transfer into the low pressure region 18, then only a limited number of cycles of the piston 20 may be accomplished before this volume of fluid is completely transferred into the low pressure region. However, described below is a "recocking" device which may be used to transfer fluid back from the low pressure region 18 to the energy source 16, so that operation of the system 10 may continue indefinitely. Alternatively, another method may be used to again fill the energy source 16 with fluid for transfer to the low pressure region 18.

If the low pressure region 18 is an internal chamber as described above, it will be readily appreciated that only a limited number of cycles of the piston 20 may be accomplished before the low pressure region 18 is at a pressure equal to that of the energy source 16. When this happens, the piston 20 cannot be displaced by a pressure differential between the pressure sources 16, 18. Therefore, it is important to conserve the limited availability of the low pressure region 18 to extend the useful life of the system 10 downhole. Of course, if the low pressure region 18 is other than an internal chamber, this limitation may not apply.

Referring additionally now to FIGS. 3A-L, another embodiment of a hydraulic control and actuation system 40 is representatively illustrated. The system 40 is similar in many respects to the system 10 described above, in that it includes a valve assembly 42 which controls communication between an actuator assembly 48 and each of an energy source 44 and a low pressure region 46. The energy source 44 is preferably, although not necessarily, an annulus external to a housing assembly 50 of the system 40. The low pressure region 46 is preferably, although not necessarily, a chamber internal to the housing assembly 50.

Prior to running the system 40 into a well, the chamber 46 may be filled with a compressible fluid, such as nitrogen or another gas. A floating piston 52 is used to separate the compressible fluid on an upper side of the piston from a relatively incompressible fluid, such as hydraulic oil, on a lower side of the piston. This fluid on the lower side of the piston 52 is in communication with the valve assembly 42 via a circuitous passage 54, not all of which is visible in the drawings.

Figure 3A:
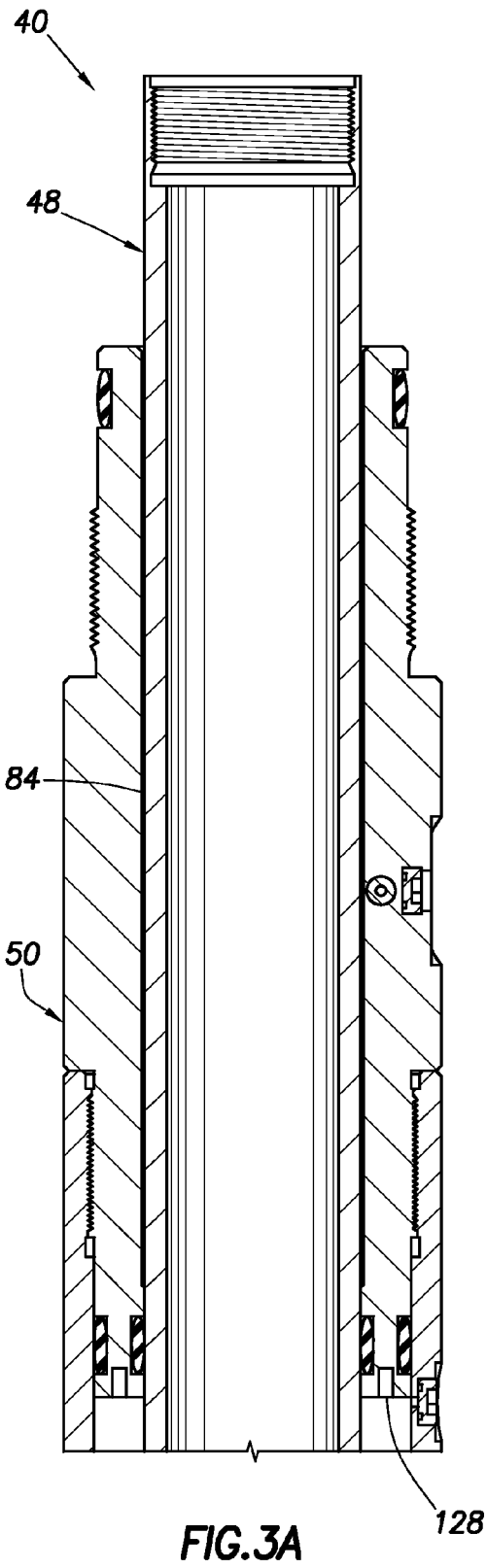
FIGS. 3A-L are cross-sectional views of successive axial sections of a hydraulic control and actuation system embodying principles of the present invention.
Figure 3B:
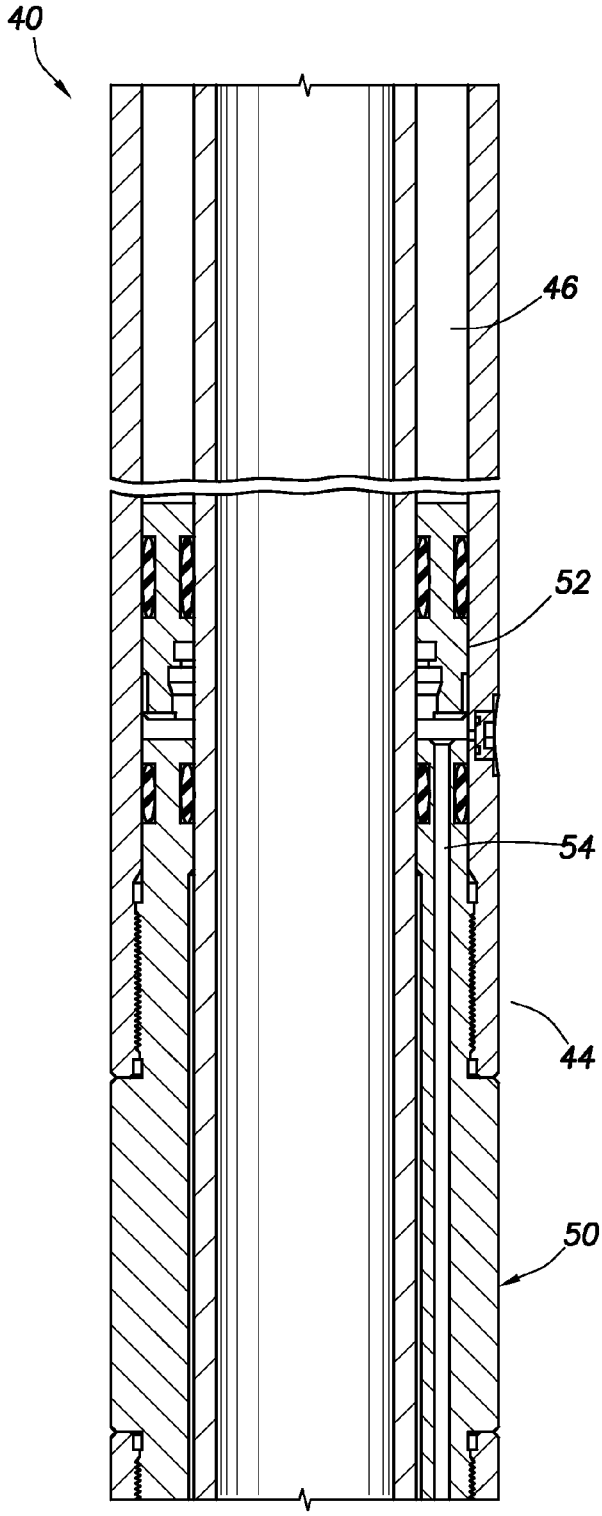

The pressure and temperature of the compressible fluid in the chamber 46 may be detected by a transducer or sensor 128 (see FIG. 3A). The sensor 128 is connected to the circuits 106 described below for monitoring the pressure and temperature in the chamber 46, and for performing other functions. For example, the amount of available volume left in the chamber 46 for receiving fluid from the valve assembly 42 may be calculated if the initial volume, pressure and temperature, and the current pressure and temperature, are known.

Furthermore, this information may be used to determine the position of the actuator assembly 48. Each time the valve assembly 42 is actuated and the actuator assembly 48 strokes upward or downward, fluid is transferred to the chamber 46, and the pressure in the chamber increases. These pressure increases are detected by the sensor 128. Thus, pressure in the chamber 46 may be used as an indication of the position of the actuator assembly 48.

These calculations and determinations may be performed in the circuits 106, and/or the pressure and temperature data may be transmitted to a remote location for analysis. Alternatively, the sensor 128 could include a switch which actuates when a predetermined pressure is reached. Actuation of the switch may be detected in the circuits 106 or at a remote location, as an indication of the position of the actuator assembly 48, as an indication of the need to "recock" the actuator, as an indication of a failure, such as a fluid leak, etc.

In order to decrease a pressure differential between the fluid in the chamber 46 and the fluid in the annulus 44, the fluid in the chamber 46 may be precharged to an elevated pressure prior to running the system 40 into the well. This decreases the pressure differential across the valve assembly 42, reducing the chance of damage to seals therein and flow cutting of passages and orifices in the system 40.

Fluid from the annulus 44 is admitted into the housing assembly 50 via openings 56. Another floating piston 58 is used to separate the annulus fluid from another fluid, such as hydraulic oil, on a lower side of the piston. The fluid on the lower side of the piston 58 is in communication with the valve assembly 42 via another circuitous passage 60, not all of which is visible in the drawings.

Another method of reducing the pressure differential across the valve assembly 42 may be used if desired. This method uses a pressure relief valve, flow regulator, flow restrictor or pressure regulator 126 (see FIG. 3E) installed in the passage 60, so that a pressure less than that in the annulus 44 is applied to the valve assembly 42. The pressure regulator 126 could alternatively, or in addition, include a flow restrictor, such as a choke which, after initial flow therethrough, reduces the differential pressure across the valve assembly 42.

The hydraulic path 60 itself may be the flow restrictor 126, in that the hydraulic path may be configured (for example, having a relatively small diameter, having turbulence-inducing profiles, etc.) so that it provides a relatively high resistance to flow therethrough. Thus, the flow restrictor (or relief valve, flow regulator or pressure regulator) 126 may be a separate element, or it may be integrally formed with another structure in the system 40.

The pressure differential across the valve assembly 42 may also be decreased by positioning the flow restrictor (or relief valve, flow regulator or pressure regulator) 126 on the output side of the valve assembly 42. That is, the flow restrictor 126 may be positioned to restrict flow through the passage 54. For example, the flow restrictor 126 could be installed in the passage 54, or integrally formed therewith, such as by configuring the passage so that it is the flow restrictor.

However, it should be understood that it is not necessary to decrease the pressure differential across the valve assembly 42 in keeping with the principles of the invention. Therefore, the chamber 46 does not necessarily need to be charged to an elevated pressure.

The passages 54, 60, and other passages described herein, may be advantageously formed in the housing assembly 50 using techniques provided in copending patent application Ser. No. 10/321,085, filed Dec. 17, 2002, entitled HYDRAULIC CIRCUIT CONSTRUCTION IN DOWNHOLE TOOLS, the disclosure of which is incorporated herein by this reference. These techniques permit complex hydraulic circuits to be formed in the limited confines of downhole tools.

The actuator assembly 48 includes a piston 62 which is specially constructed to conserve the number of cycles it may displace before the internal chamber 46 reaches a pressure too near the pressure in the annulus 44 to be useful in displacing the piston. Specifically, the piston 62 has a greater effective piston area at the beginning of its stroke than at the end of its stroke.

The larger piston area at the beginning of the piston 62 stroke may be used to start actuation of a well tool (such as the well tool 26), when a larger force is typically needed (e.g., to initiate movement of a valve closure member or to shear pins to begin setting a packer). The smaller piston area in the remainder of the piston 62 stroke produces a sufficient force to maintain actuation of the well tool 26, but does not transfer as large a volume of fluid to the internal chamber 46 per unit of stroke as does the larger piston area. This reduces the volume of fluid transferred to the internal chamber 46 on each cycle of the piston 62.

Figure 3C:
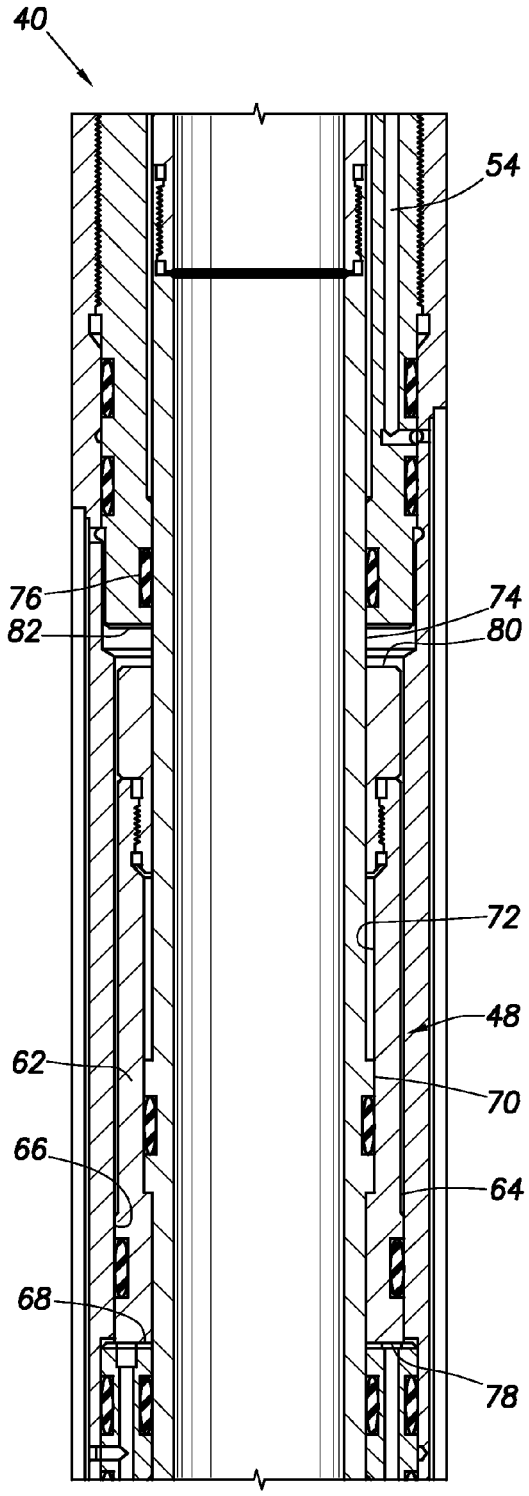
Figure 3D:
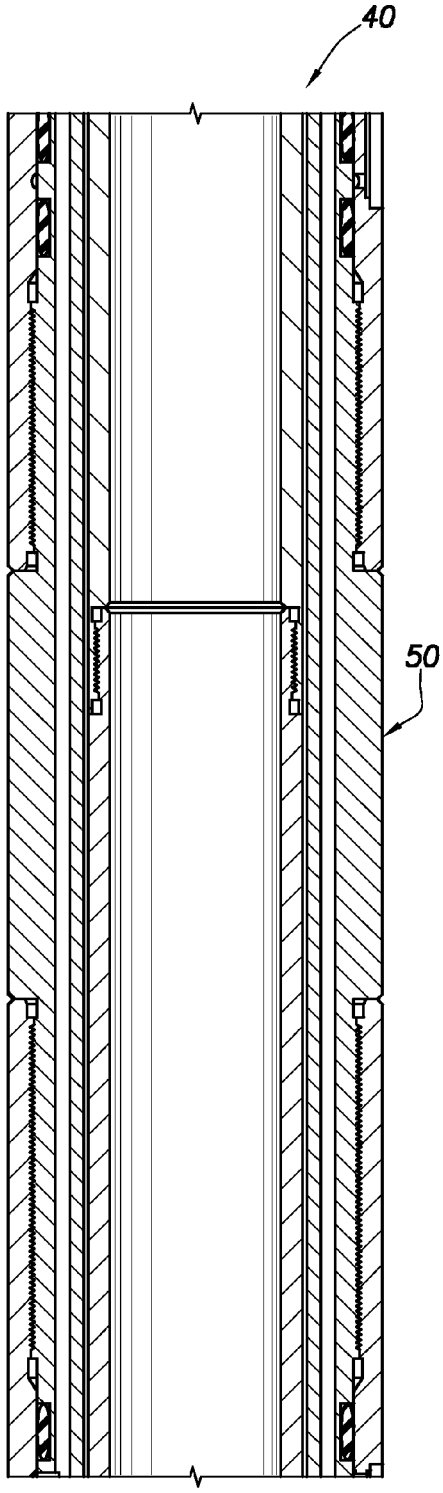
Figure 3E:
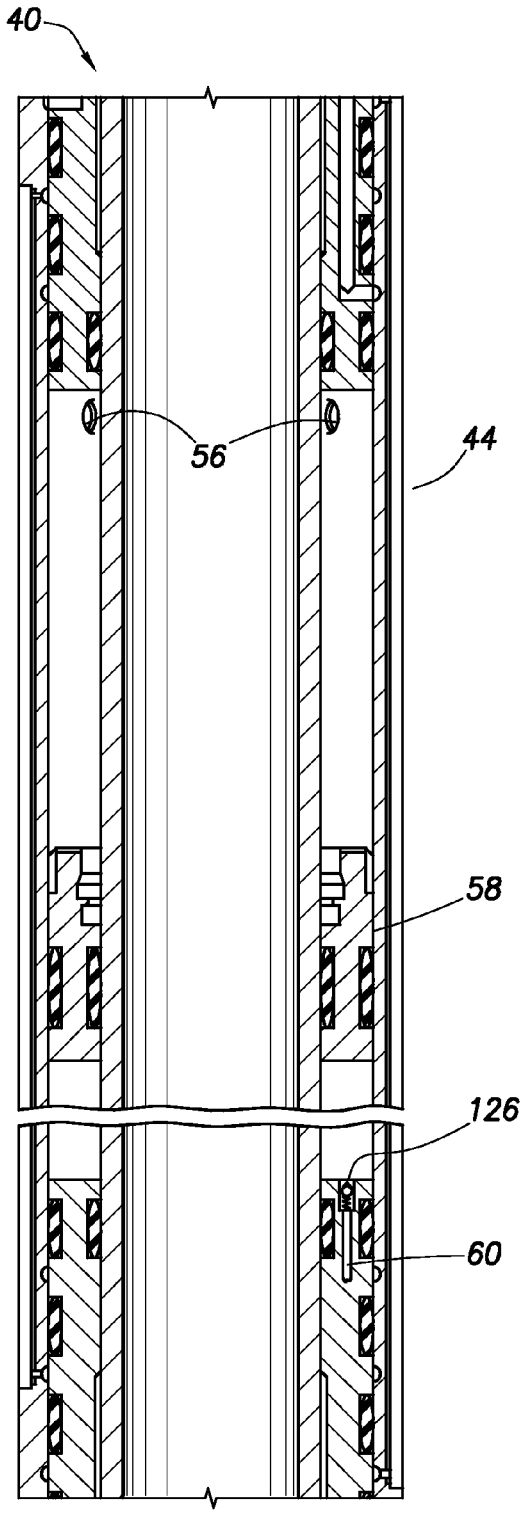

As viewed in FIG. 3C, the piston 62 is in its lowermost position. An outer sleeve 64 is sealingly received in a bore 66 of the housing assembly 50 and is in contact with an upwardly facing shoulder 68. An inner mandrel 70 is sealingly received within a radially enlarged bore 72 of the outer sleeve 64, and has an outer surface 74 which is sealingly engaged by a seal 76 of the housing assembly 50.

If pressure on a lower side 78 of the piston 62 is greater than pressure on an upper side 80 of the piston, the piston will be biased upward. It will be readily appreciated by one skilled in the art that, with the system 40 in the configuration illustrated in FIGS. 3A-L and a pressure differential biasing the piston 62 upward, the effective piston area of the piston is the annular area between the bore 66 and the surface 74.

Figure 8A:
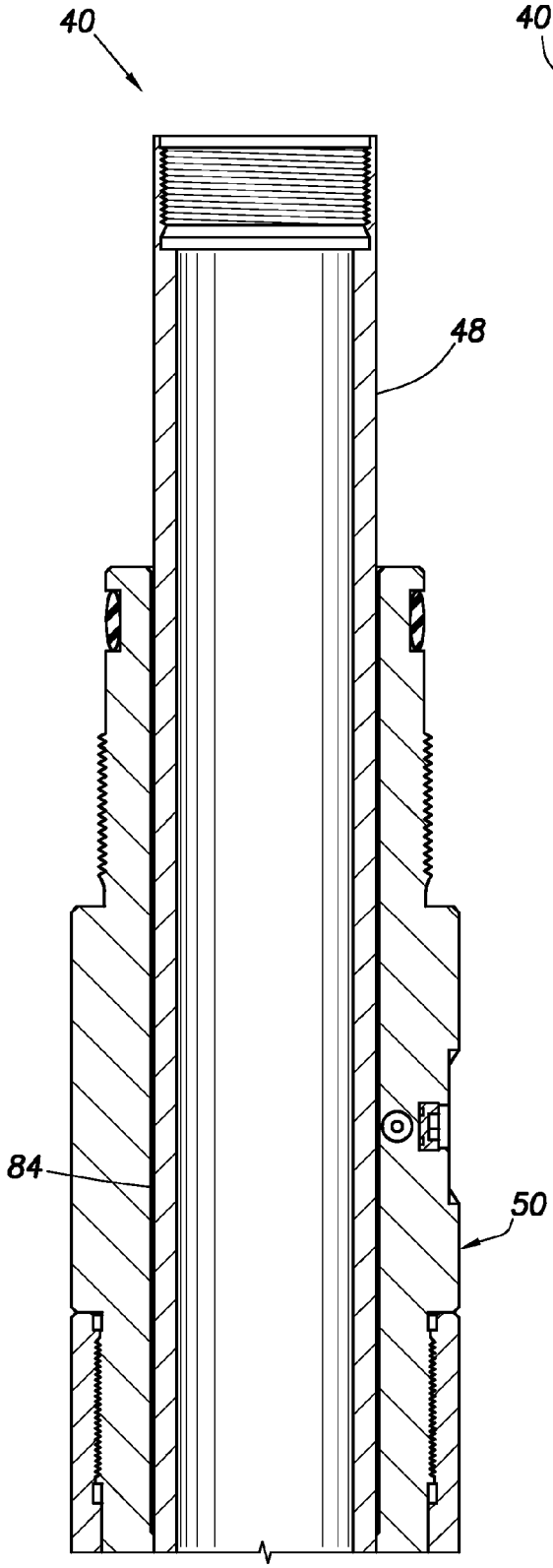
FIGS. 8A-L are cross-sectional views of successive axial sections of the hydraulic control and actuation system of FIG. 3 in a second configuration.
Figure 8B:
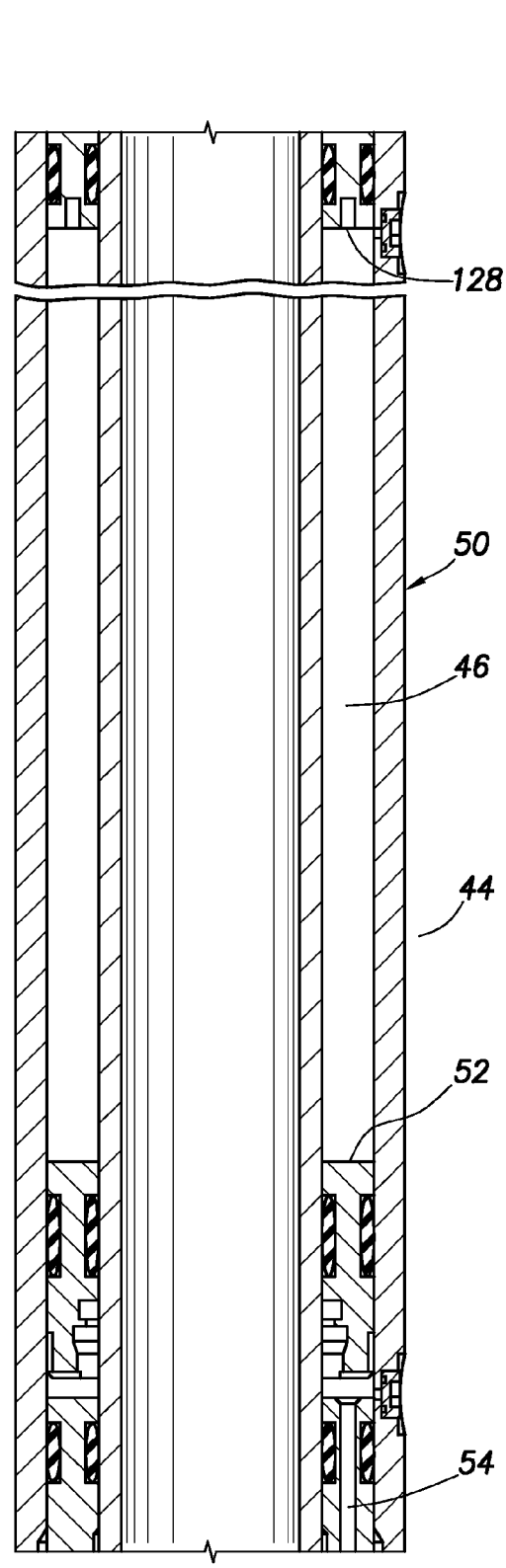
Figure 8C:
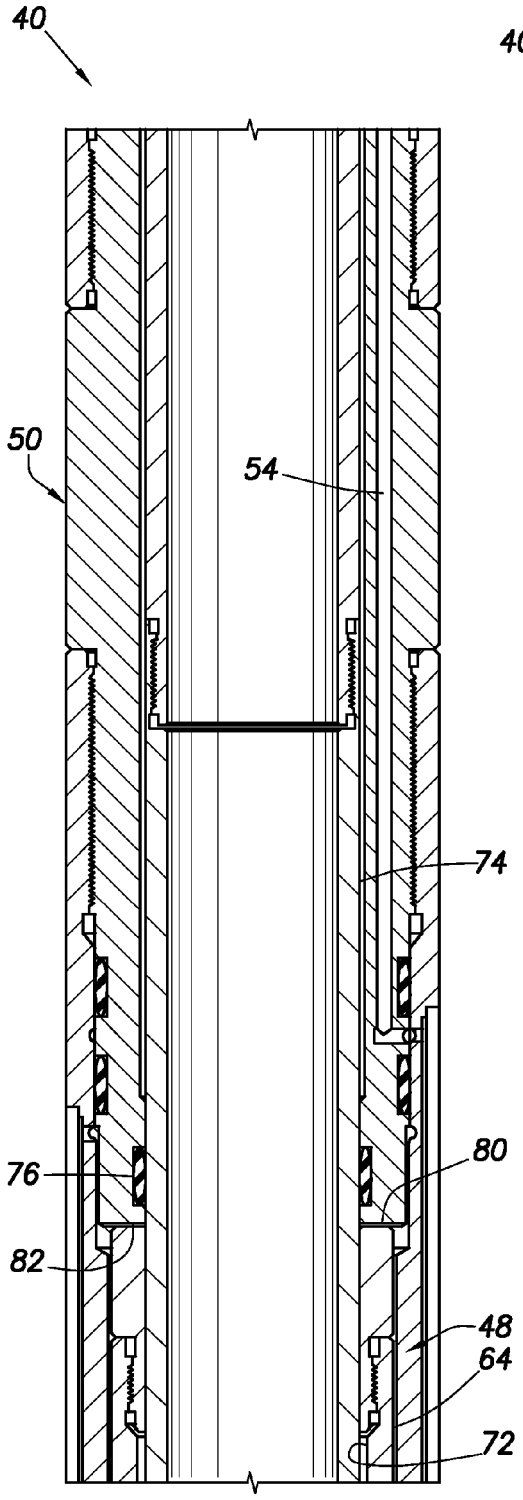
Figure 8D:
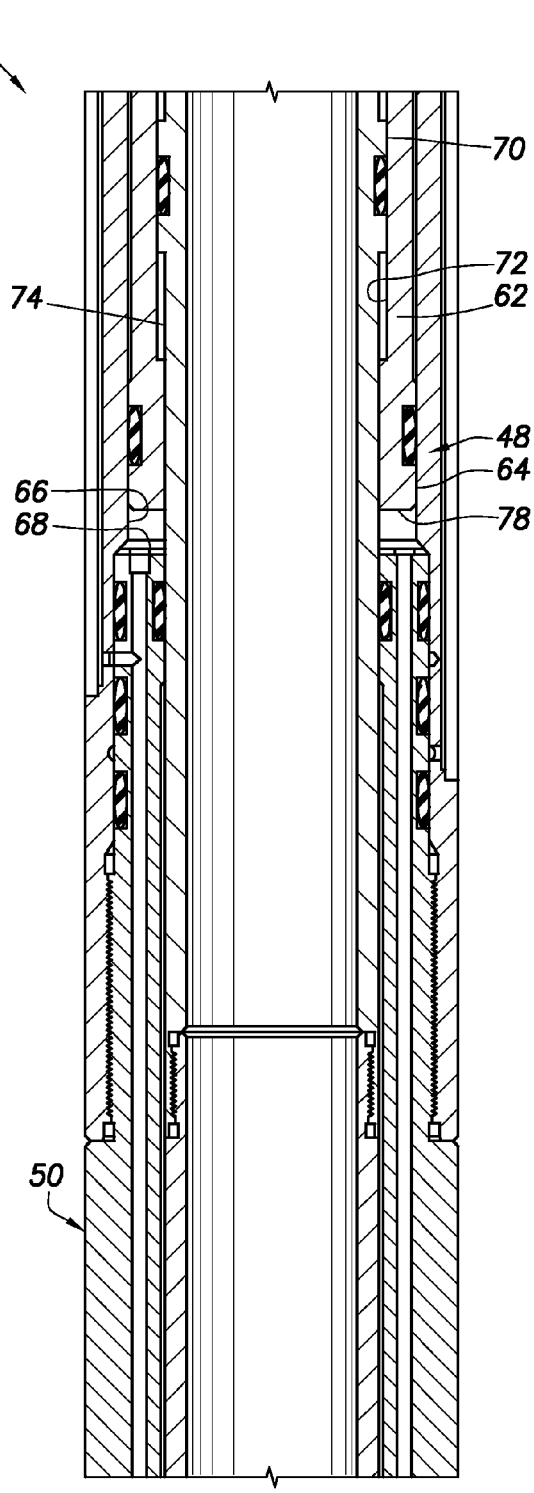
Figure 8E:
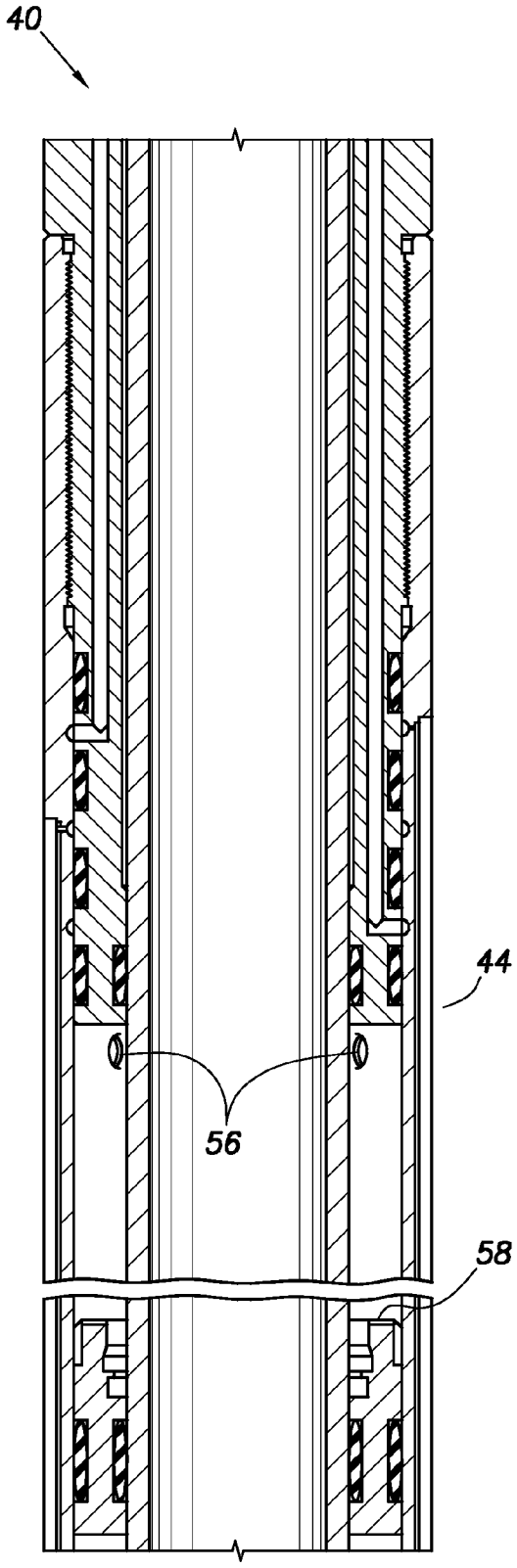
Figure 8F:
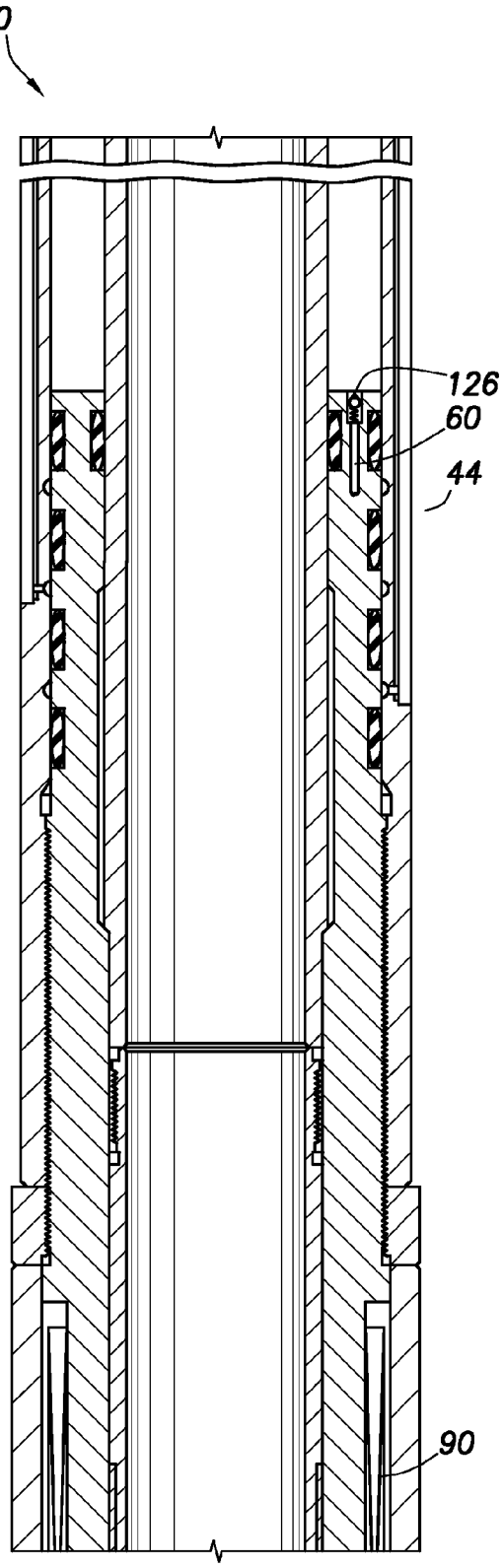
Figure 8G:
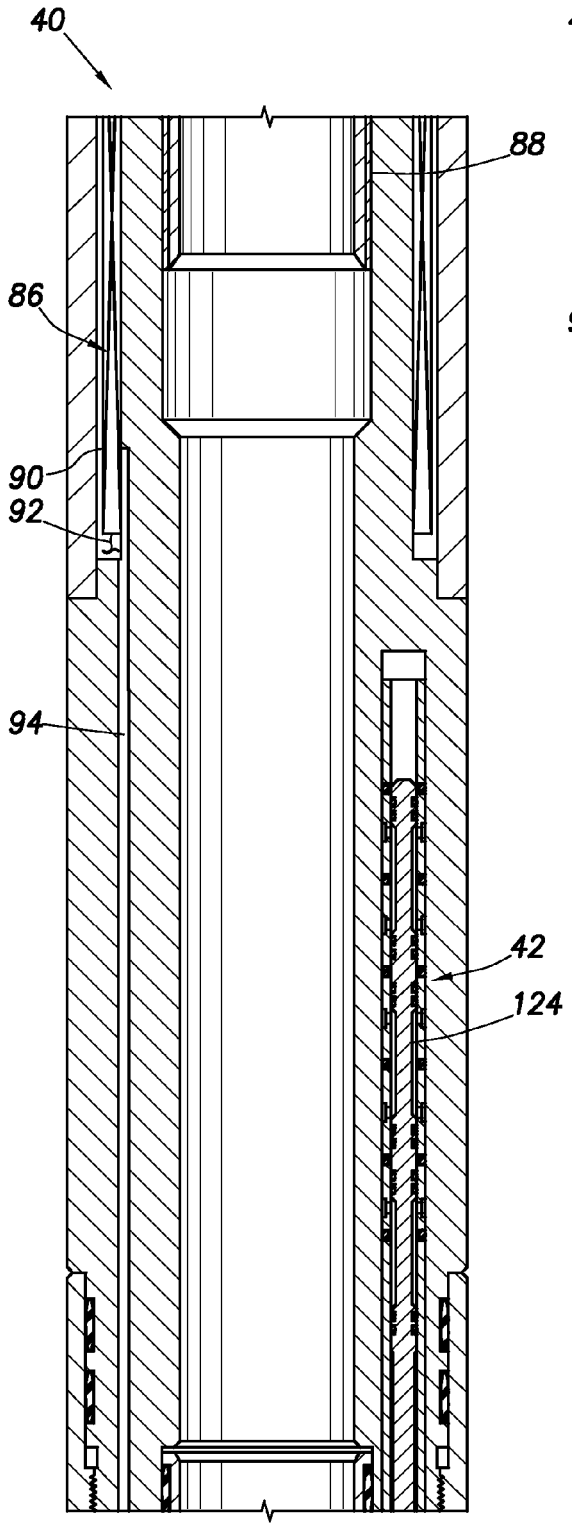
Figure 8H:
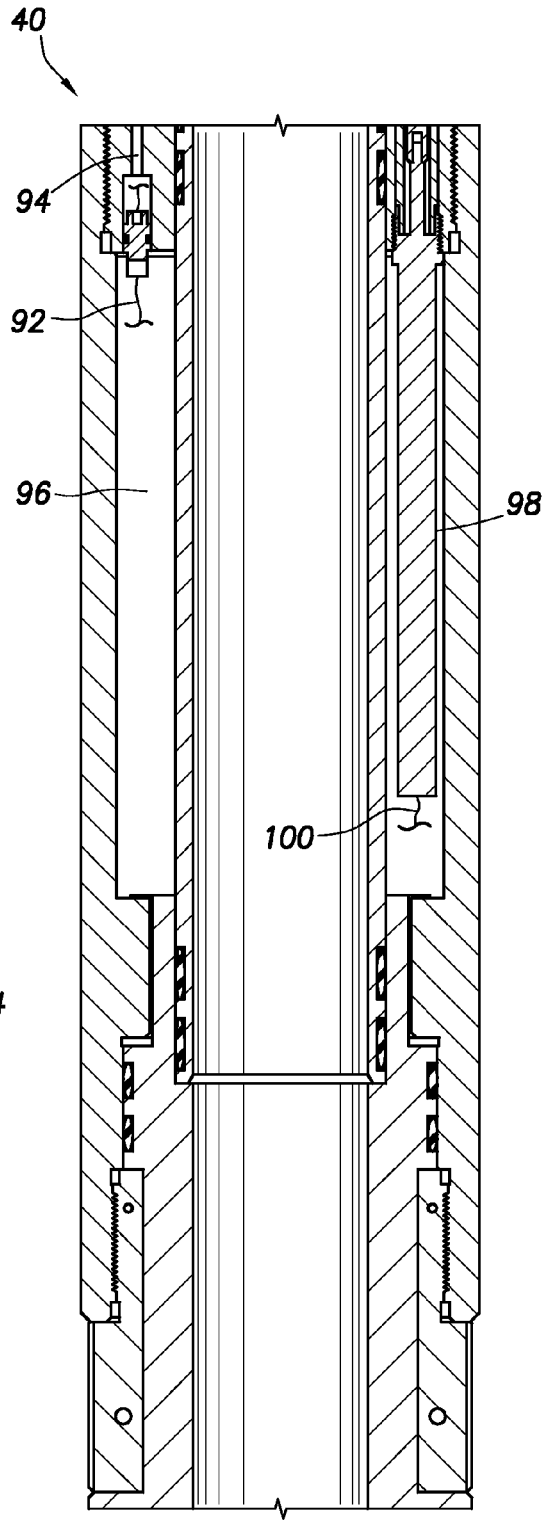
Figure 8I:
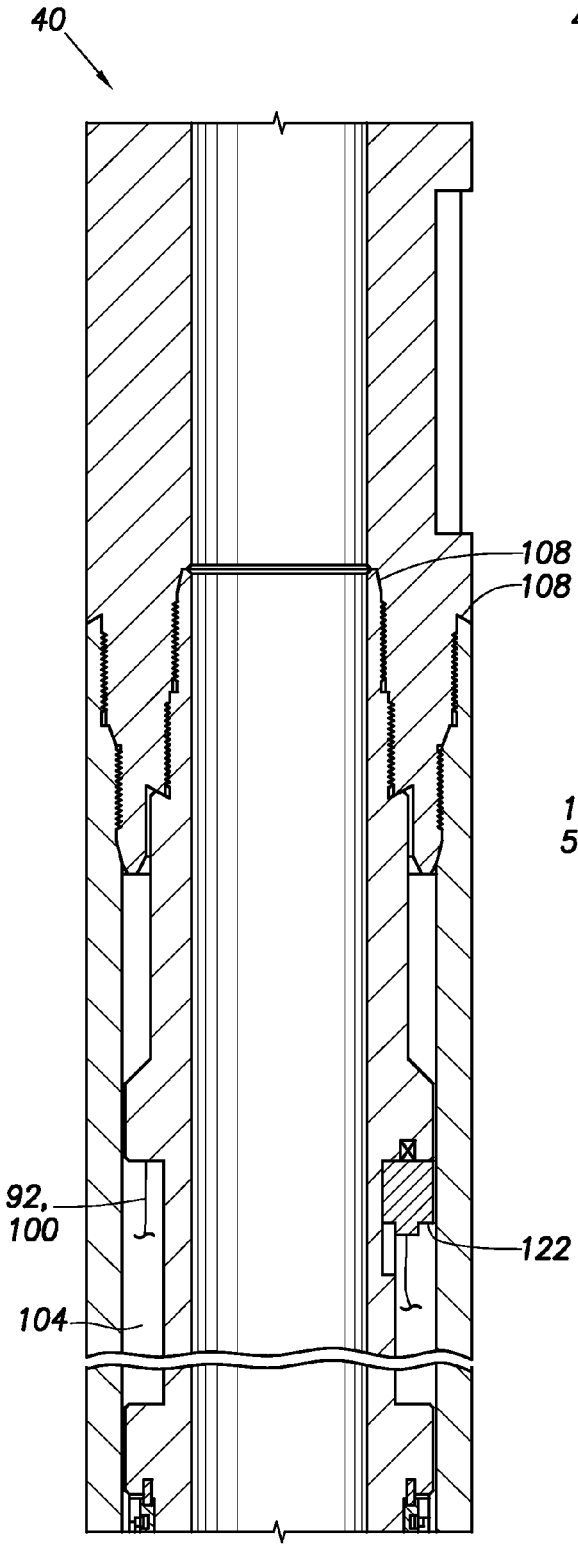
Figure 8J:
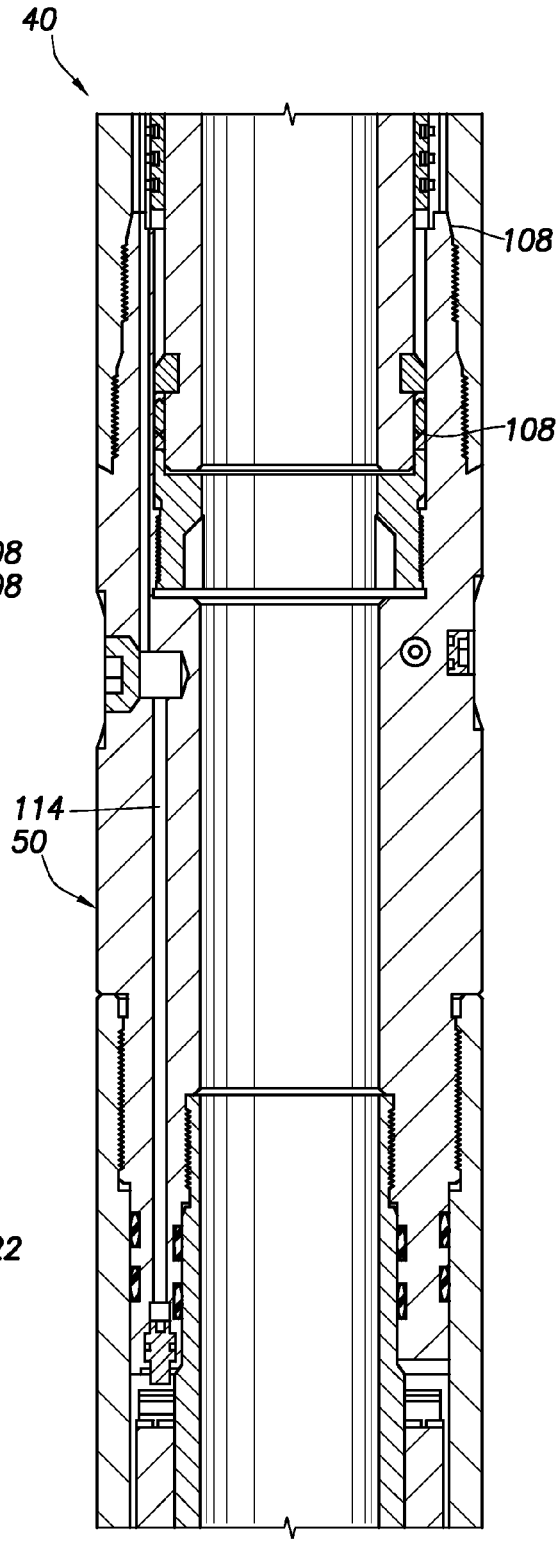
Figure 8K:
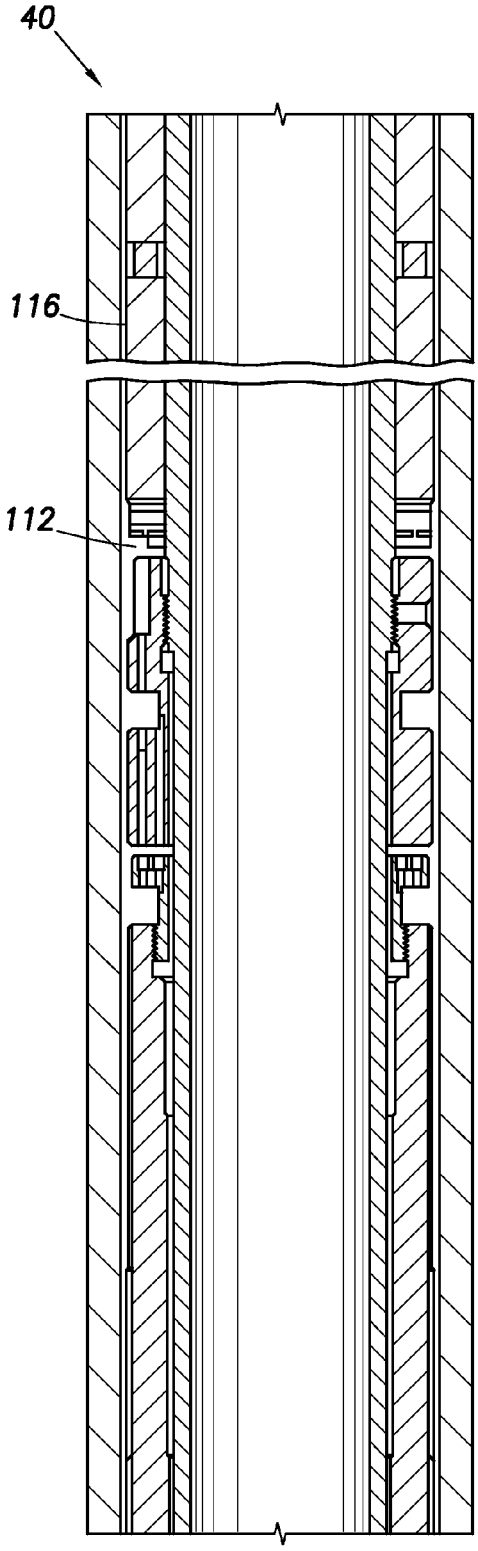
Figure 8L:
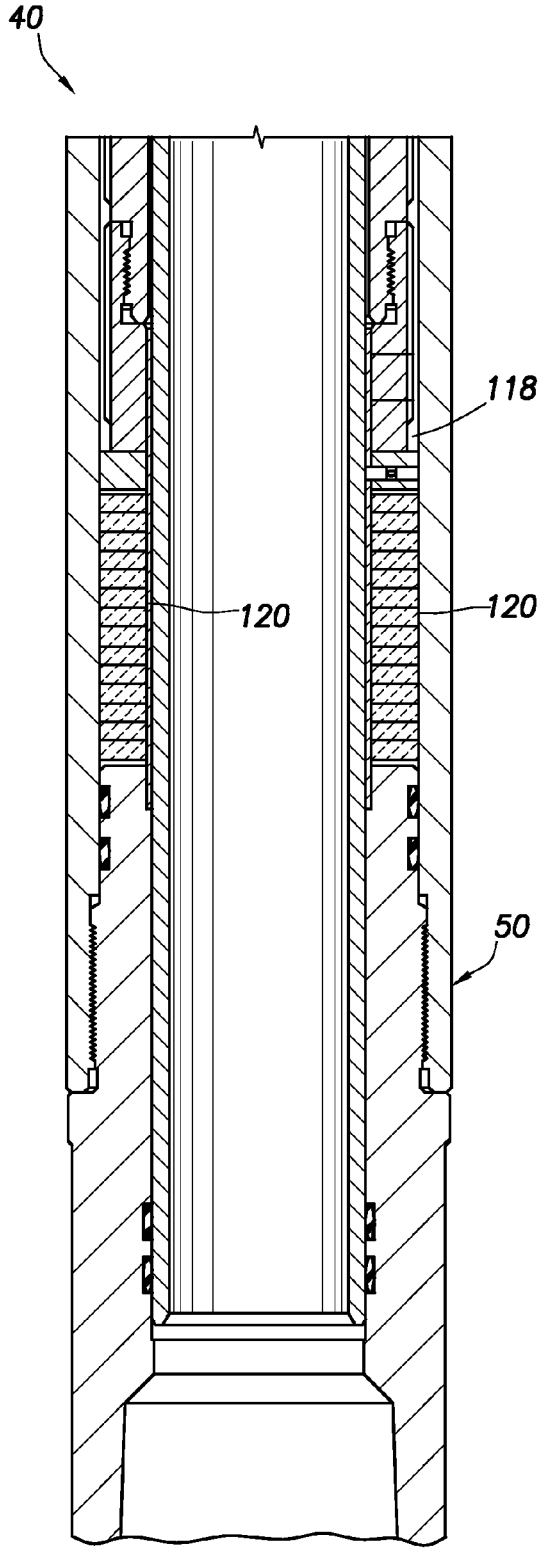

However, when the outer sleeve 64 contacts a downwardly facing shoulder 82 of the housing assembly 50 and further upward displacement of the outer sleeve 64 is prevented, then the effective piston area of the piston 62 becomes the annular area between the bore 72 and the surface 74 by pressure applied to the lower side 78 of piston 62 communicated between piston 62 and inner mandrel 84, as shown in FIG. 8D. This is a significant reduction in area of the piston 62 during its displacement, which significantly reduces the volume of fluid transferred to the internal chamber 46.

In FIGS. 8A-L, the system 40 is illustrated after the outer sleeve 64 has contacted the shoulder 82. The inner mandrel 74 continues to displace upward under the biasing effect of the pressure differential from the annulus 44 to the internal chamber 46.

In FIGS. 9A-L, the system 40 is illustrated after the inner mandrel 74 has reached the upper extent of its stroke. At this point, if the valve assembly 42 is operated to place the upper side 80 of the piston 62 in communication with the annulus 44 and the lower side 78 of the piston in communication with the internal chamber 46, the piston will be biased downward by the pressure differential between the annulus and the internal chamber.

The effective piston area of the piston 62 will again change when the piston strokes downward. At the beginning of the piston 62 stroke, the effective piston area will be the annular area between the bore 66 and the surface 74. When the outer sleeve 64 contacts the shoulder 68, the effective piston area will be the smaller annular area between the bore 72 and the surface 74.

This smaller effective piston area again acts to reduce the volume of fluid transferred to the internal chamber 46. Therefore, it will be readily appreciated that the special configuration of the piston 62 conserves the available volume of the internal chamber 46, whether the piston displaces upwardly or downwardly in the housing assembly 50.

In some circumstances it may be preferable for the effective piston area of the piston 62 to increase, rather than decrease, as the piston displaces. For example, a particular well tool may require greater force at the end of its actuation, rather than at the beginning of its actuation. In these cases, the piston 62 may instead be configured so that its effective piston area is greater at the end of its stroke than at the beginning of its stroke.

Note that the inner mandrel 70 is connected to another mandrel 84 which extends upwardly out of the housing assembly 40, as viewed in FIG. 3A. In actual practice, the mandrel 84 is preferably connected to a displaceable operator member (not shown) of the well tool 26. Displacement of the piston 62 also displaces the mandrel 84, thereby operating the well tool 26 to which it is connected.

Figure 3F:
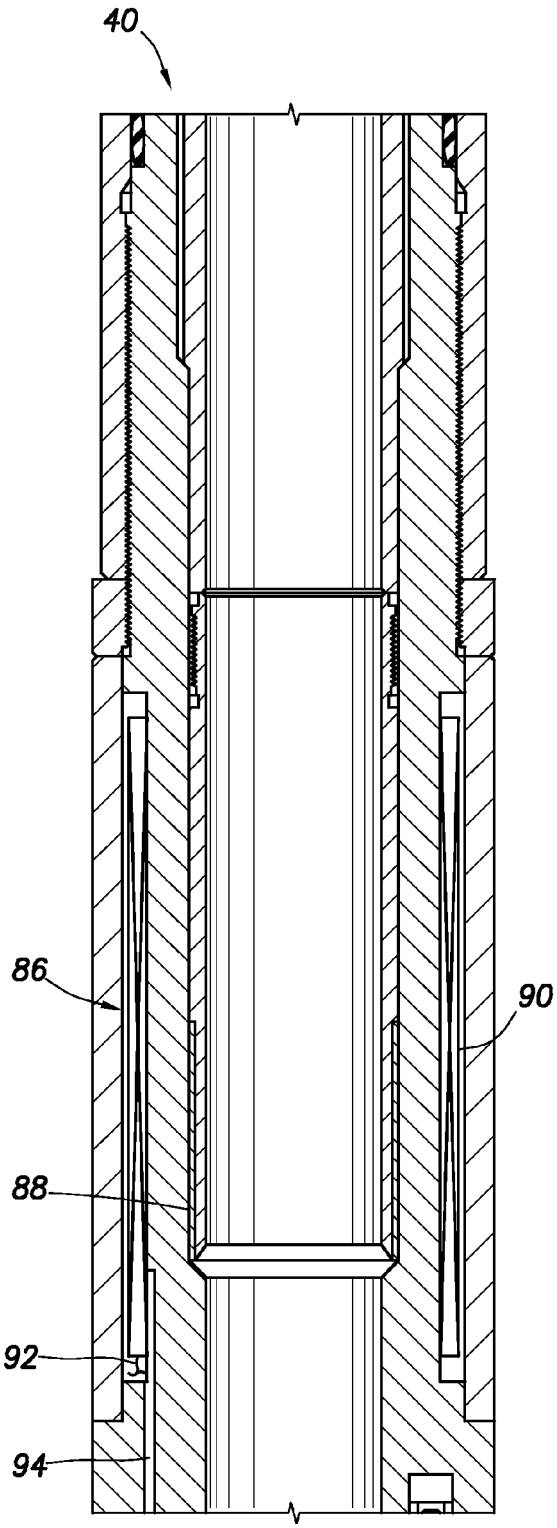
Figure 3G:
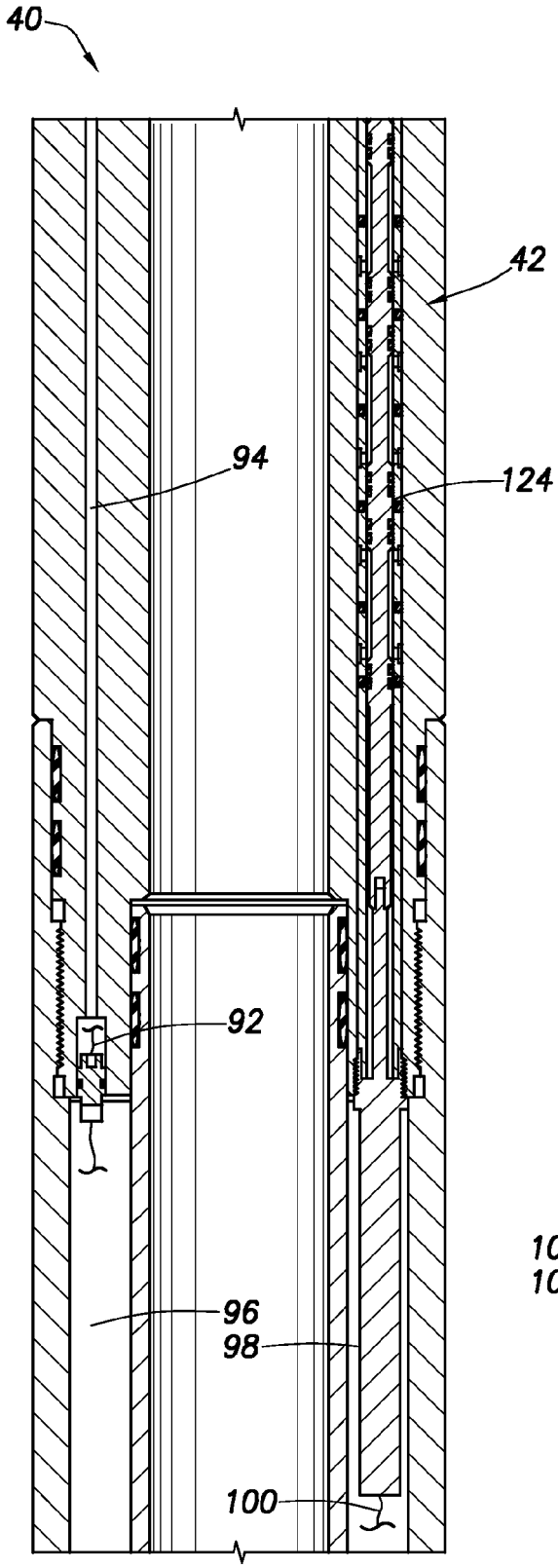
Figure 3H:
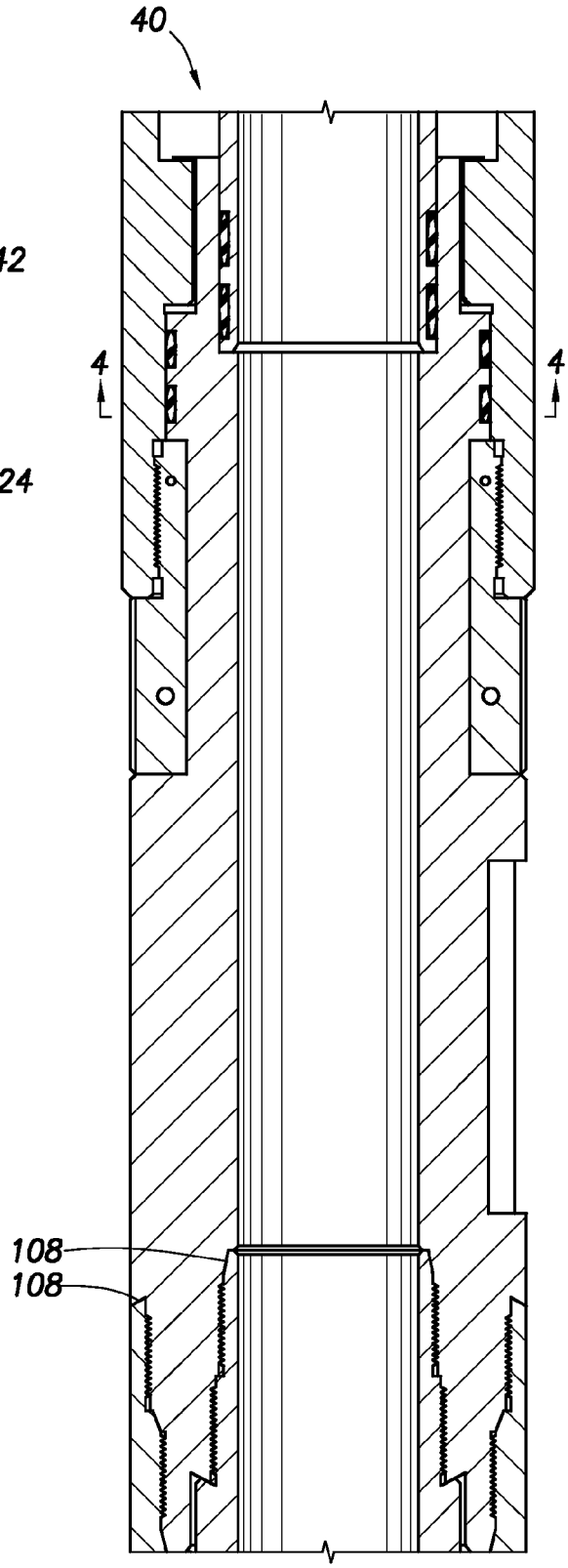
Figure 3I:
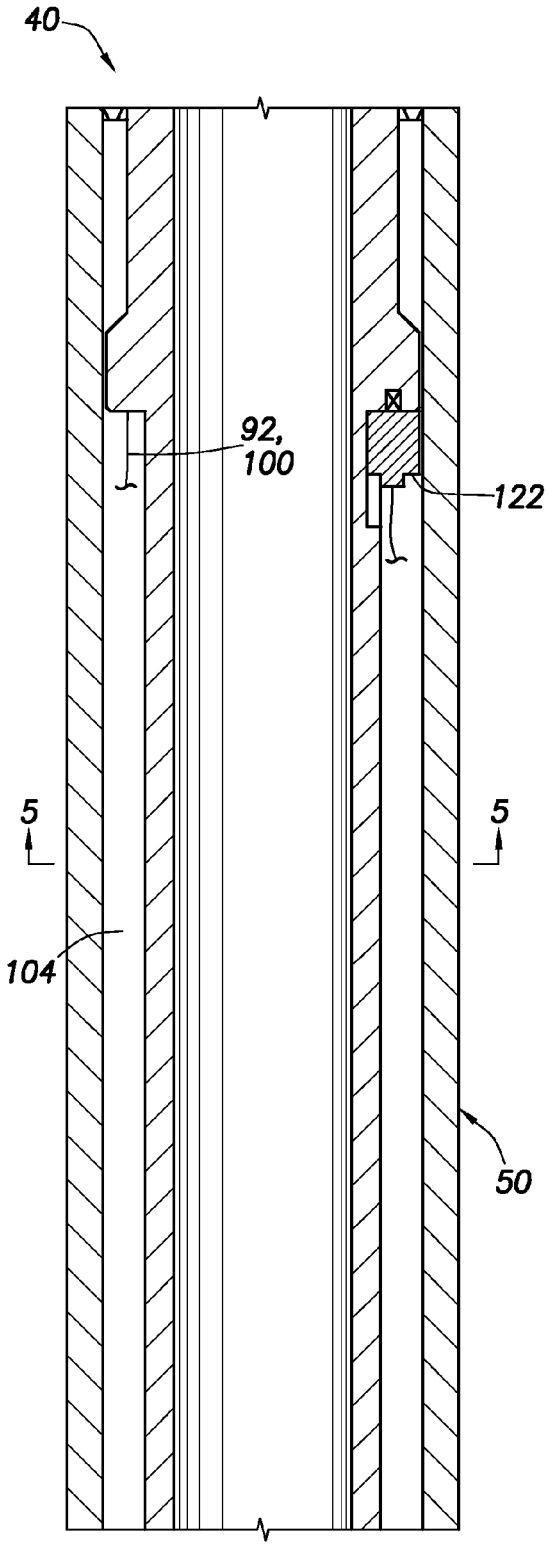
Figure 3J:
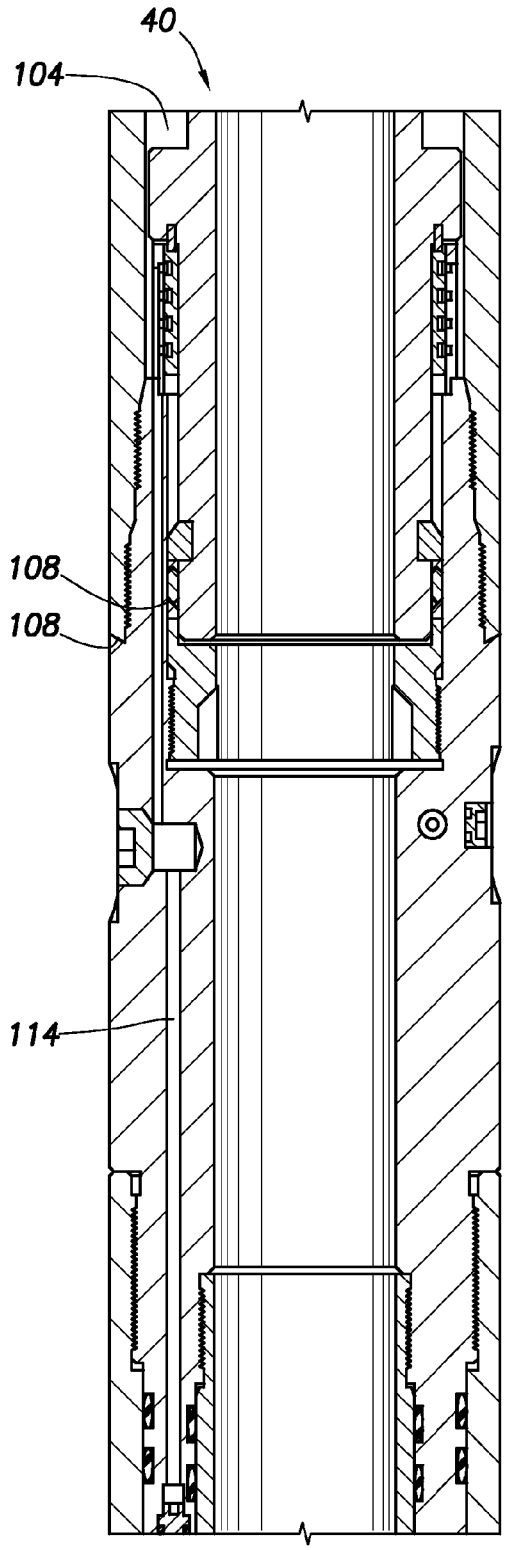
Figure 3K:
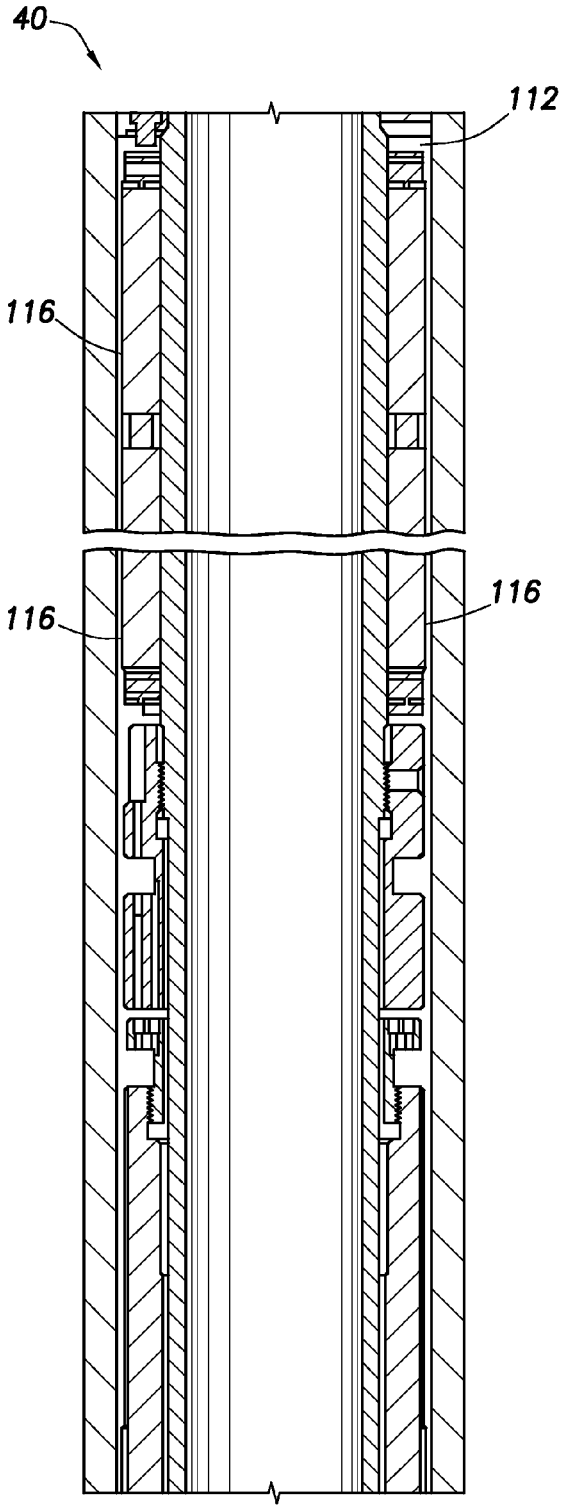
Figure 3L:
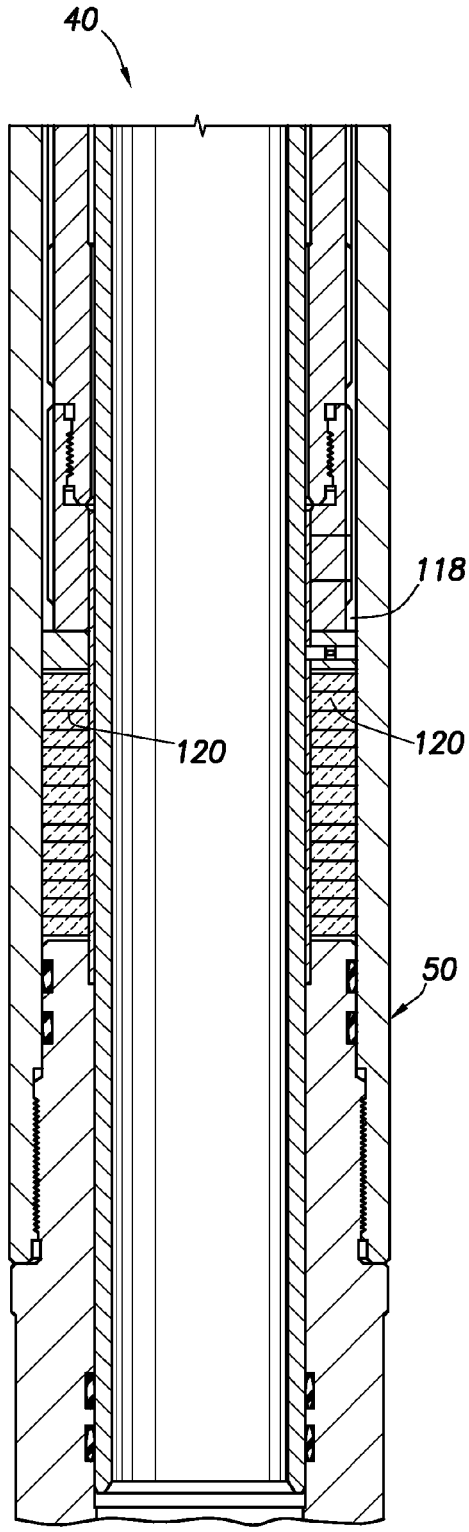

To detect the position of the piston 62, the system 40 includes a position sensor 86. The position sensor 86 may be a linear variable displacement transducer, a Hall effect sensor, or any other type of position sensor known to those skilled in the art. As depicted in FIG. 3F, the sensor 86 includes a magnetic material 88 carried on the mandrel 70. The magnetic material 88 is positioned within an electrical coil go. As the magnetic material 88 displaces through the coil go, the output of the coil varies, providing an indication of the position of the piston 62 relative to the housing assembly 50.

Electrical leads 92 from the coil go extend through a passage 94 to an internal annular chamber 96 of the housing assembly 50. In this chamber 96 is also positioned an electric motor 98 of the valve assembly 42. The motor 98 is used to displace a member or shuttle 124 of the valve assembly 42 (similar to the shuttle 28 of the valve assembly 12 described above).

Note that it is not necessary in keeping with the principles of the invention, for the shuttle 124 to be displaced by the motor 98, since other means, including other electro-mechanical devices, may be used to displace the shuttle. For example, the motor 98 could instead be an electric solenoid which displaces the shuttle 124, or pressure could be applied to opposite ends of the shuttle (as described above for displacement of the shuttle 28), etc.

The motor 98 is preferably of the type which includes a means of outputting a signal to indicate revolutions, or fractions of revolutions, of the motor. Since there is a known relationship between the number of revolutions of the motor 98 and displacement of the shuttle 124, the displacement of the shuttle in the valve assembly 42 may be determined from the signal output by the motor. Alternatively, a position sensor, such as a linear variable displacement transducer, could be used to determine the position of the motor 98 and/or shuttle 124. This information may be transmitted to a remote location to monitor the status and progress of the valve assembly's 42 operation.

To calibrate the position of the shuttle 124 as indicated by any of the above sensors, transducers or other output means, the shuttle may be displaced to either end of its stroke, and then the indicator, sensor, etc. may be "zeroed". If the revolution counter is used, the revolutions may be counted, beginning from this "zeroed" position.

Figure 9A:
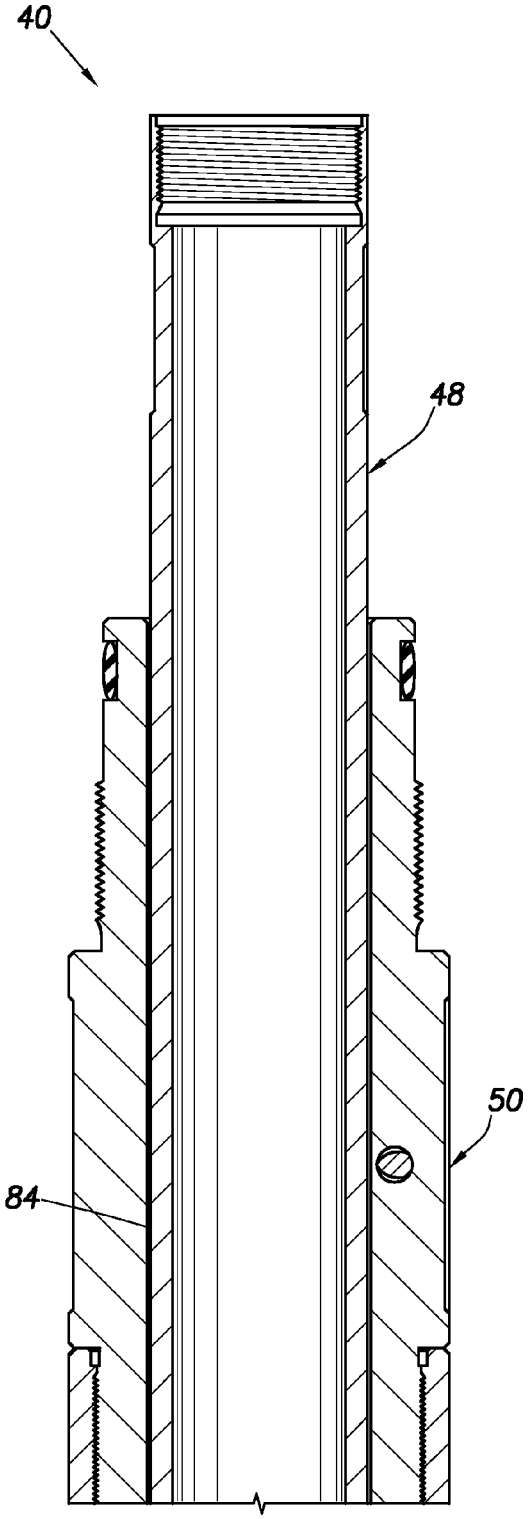
FIGS. 9A-L are cross-sectional views of successive axial sections of the hydraulic control and actuation system of FIG. 3 in a third configuration.
Figure 9B:
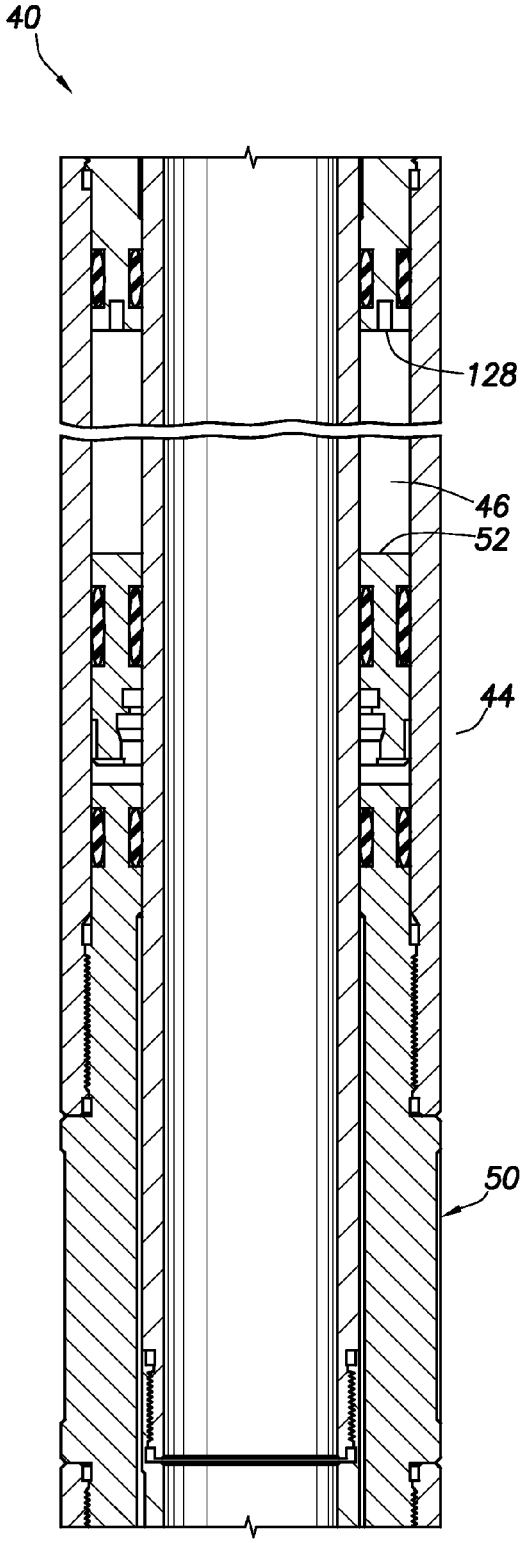
Figure 9C:
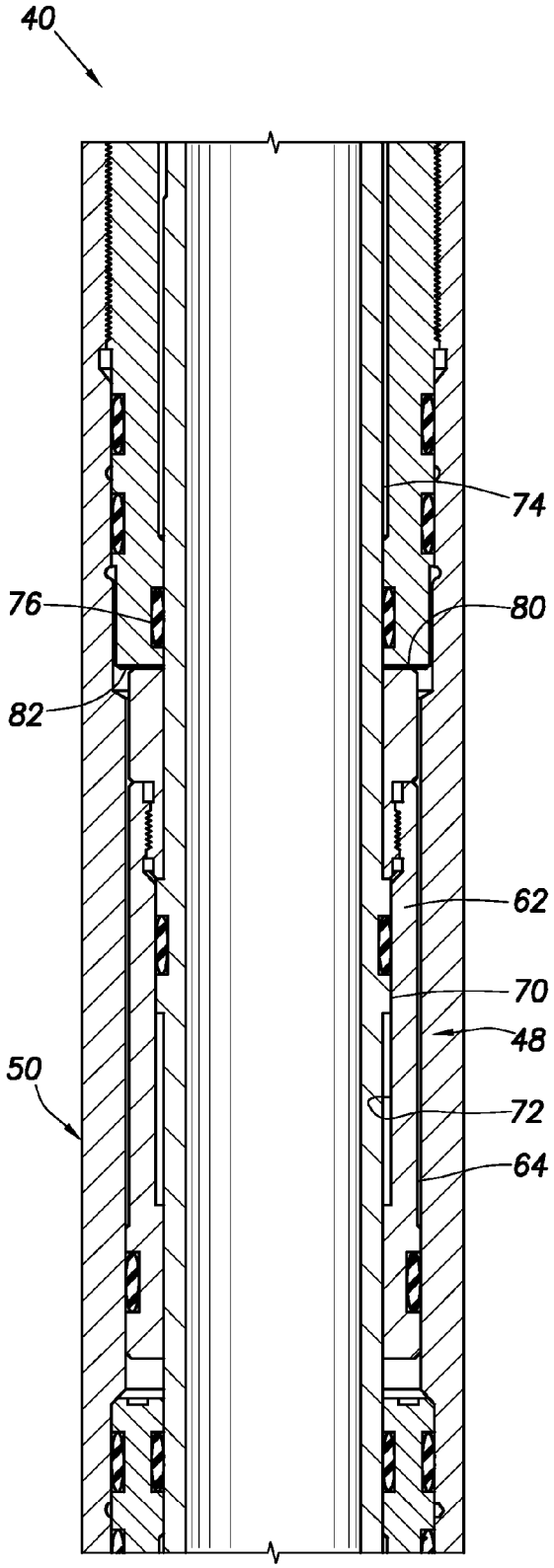
Figure 9D:
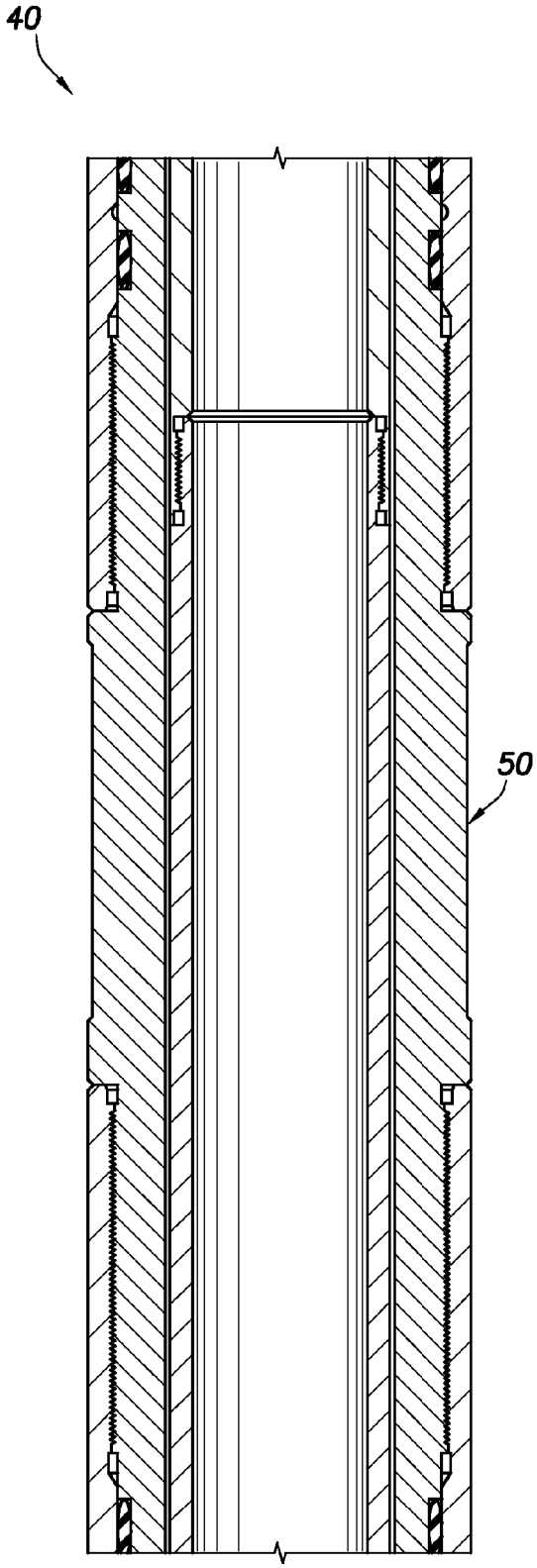
Figure 9E:
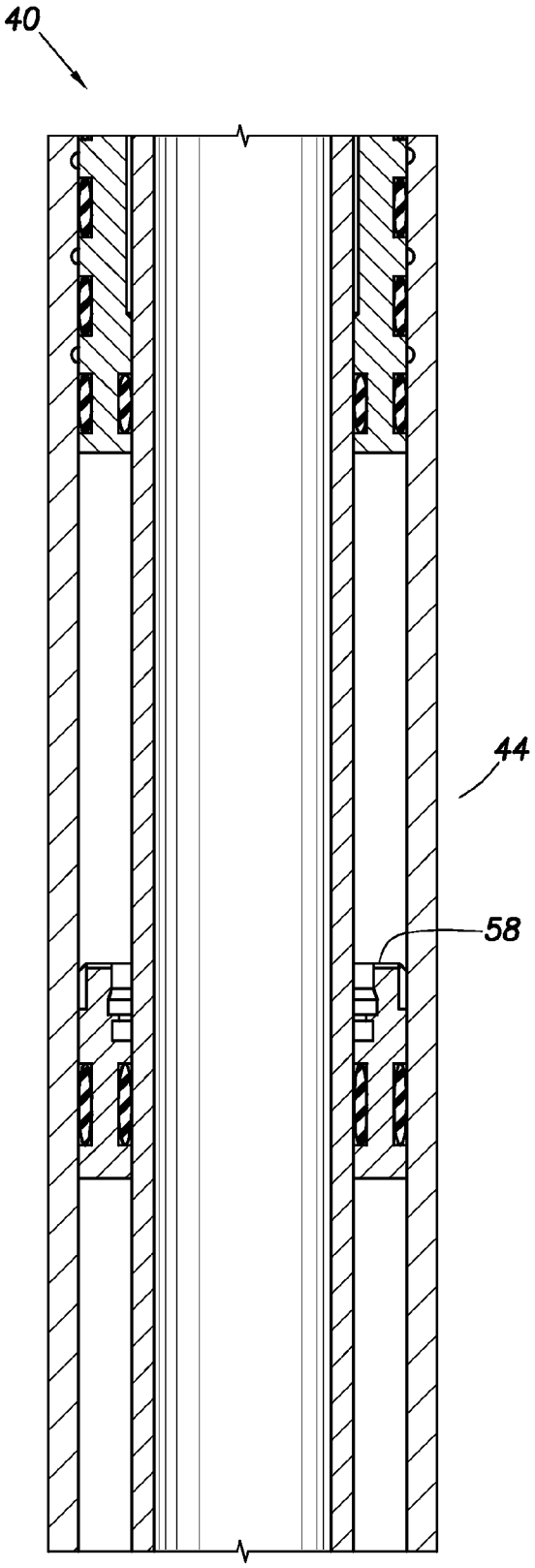
Figure 9F:
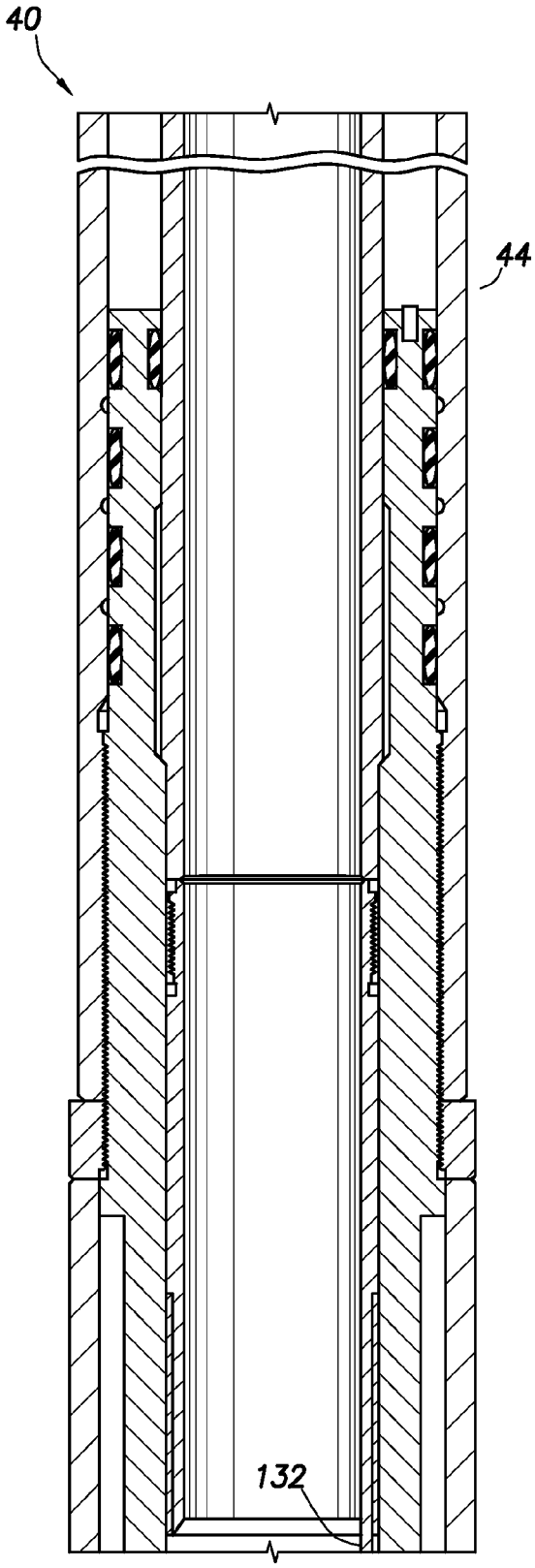
Figure 9G:
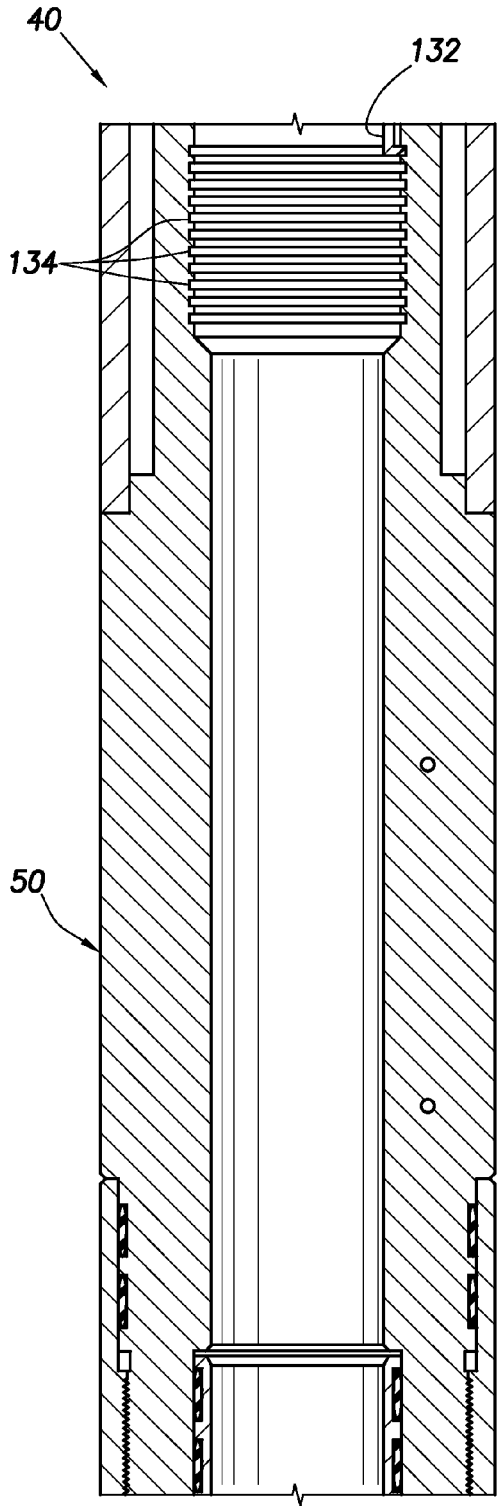
Figure 9H:
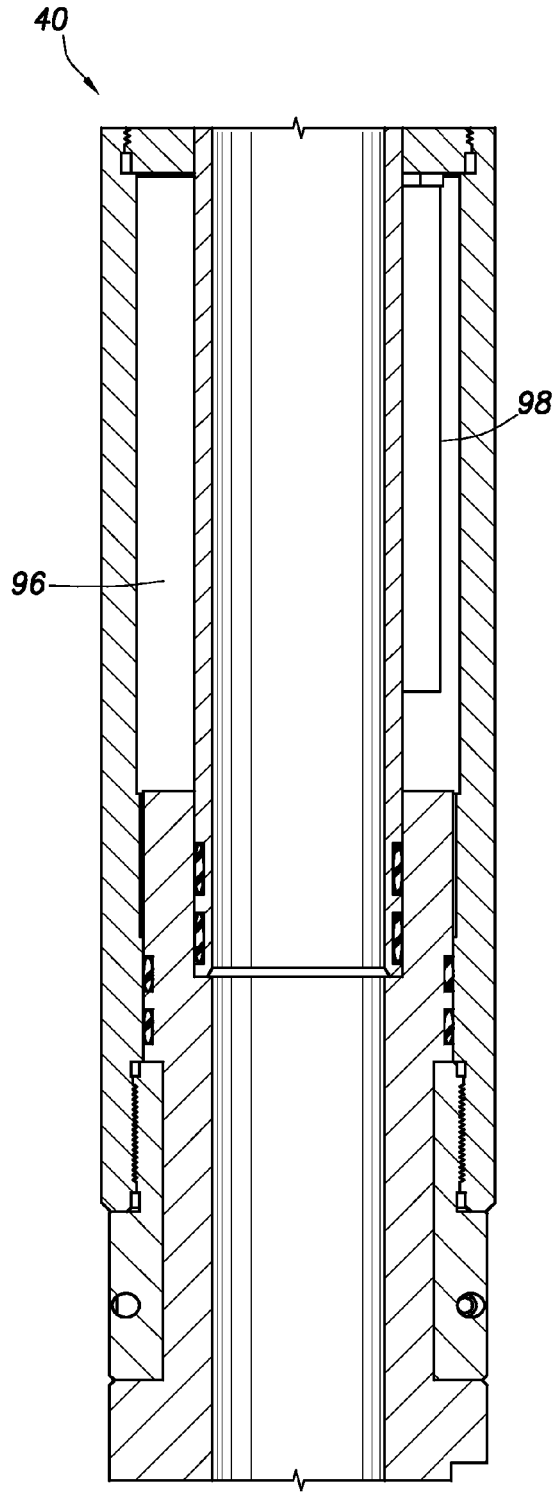
Figure 9I:
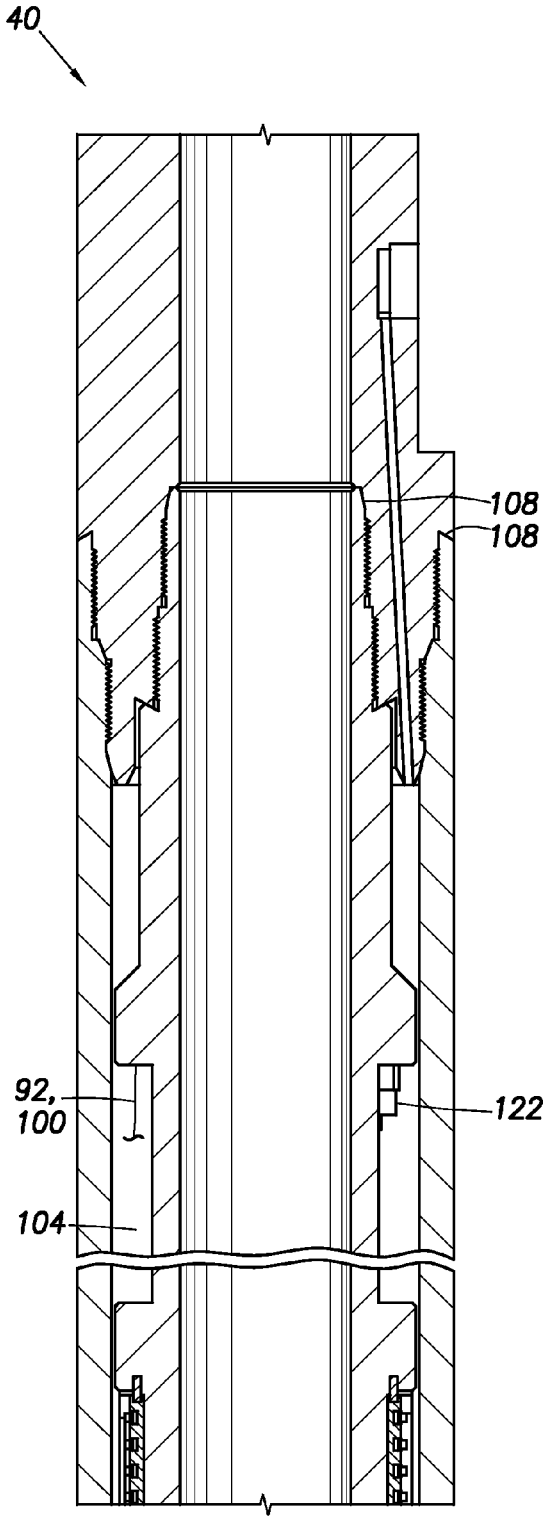
Figure 9J:
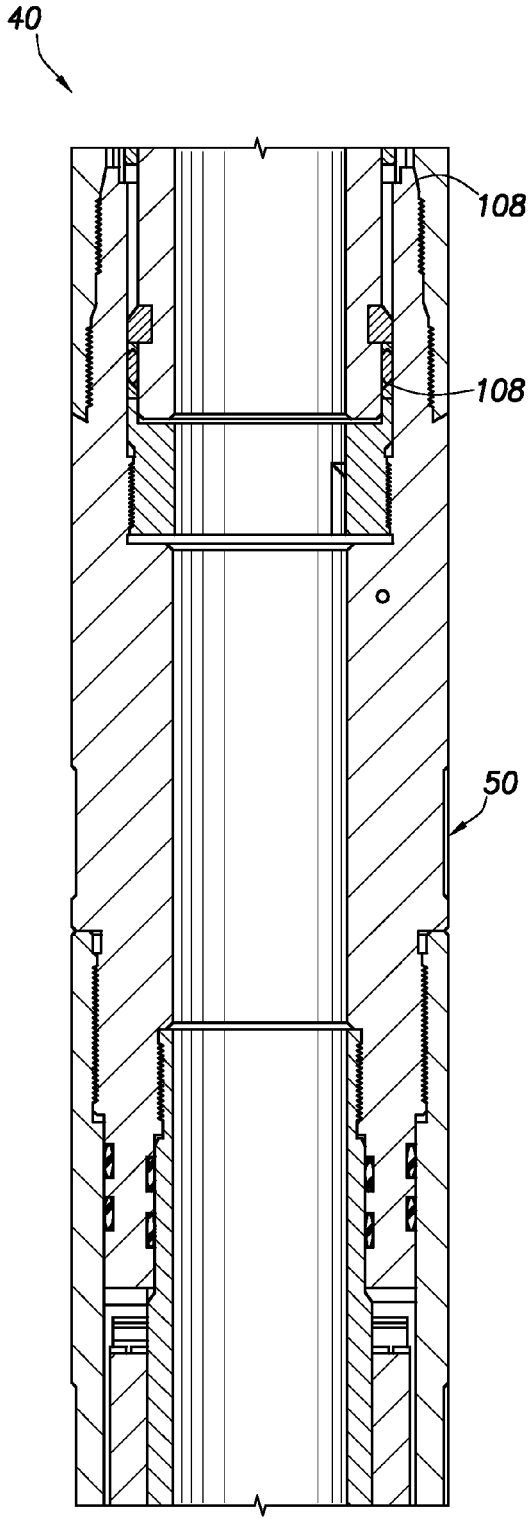
Figure 9K:
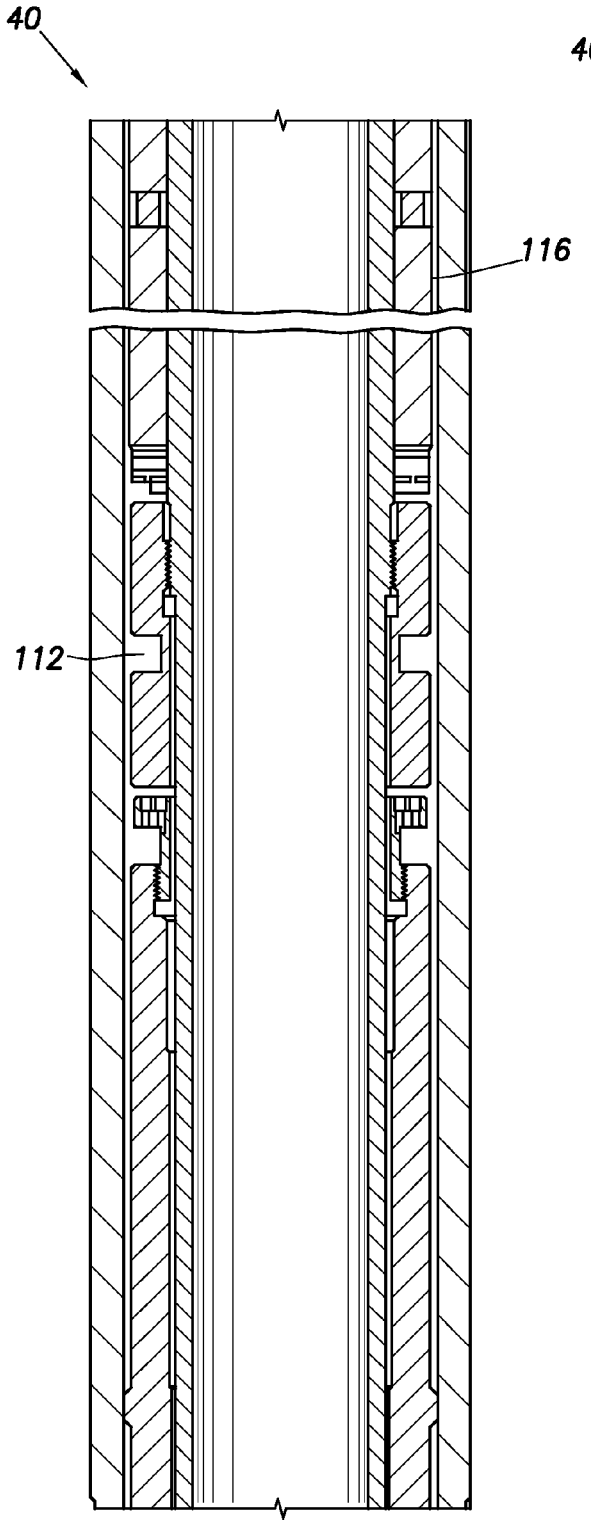
Figure 9L:
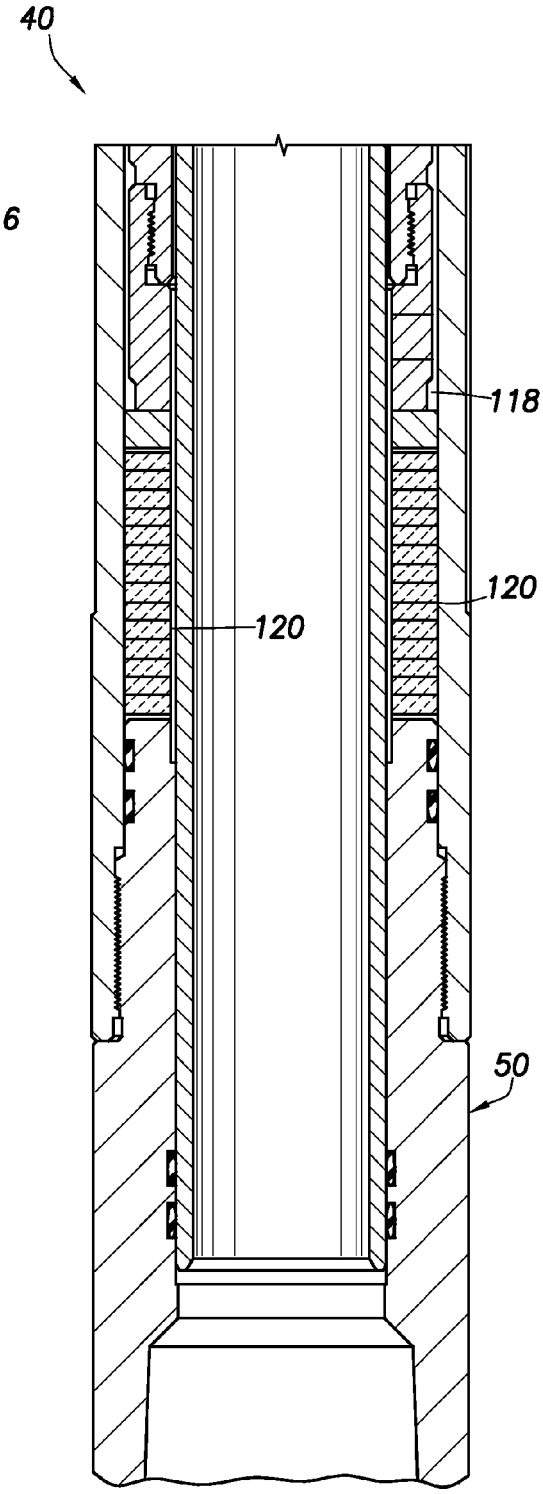

An alternate method of detecting the position of the piston 62 is shown in FIGS. 9F & G. A spring-biased striker 132 engages a series of grooves 134 formed in the housing assembly 50. As the piston 62 displaces, the striker 132 displaces from one groove 134 to another, producing an impact each time the striker enters one of the grooves. The impacts are detected by an accelerometer 122 (see FIG. 3I). By counting the number of impacts, the position of the piston 62 may be determined.

Another alternative method of detecting the position of the piston 62 is to detect (for example, using the accelerometer 122) when a shoulder has been contacted, such as, at an end of its stroke, or when the outer sleeve 64 contacts the shoulder 68 or the shoulder 82. The accelerometer 122 may also, or alternatively, be used to detect when the tool 26 has been actuated, such as, by detecting an element of the tool contacting another element, for example, a sliding sleeve contacting a shoulder, or by detecting other movement, for example, a shear pin of a packer shearing, etc.

Figure 4:
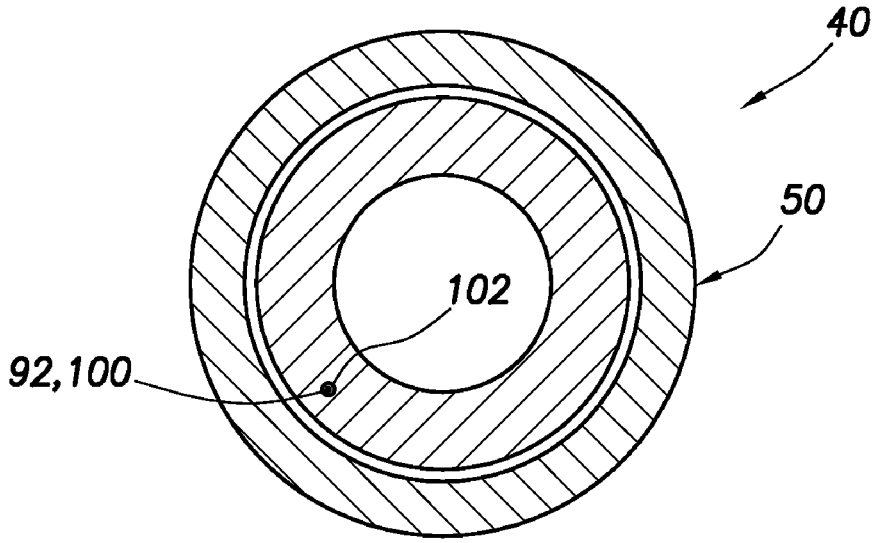
FIG. 4 is a cross-sectional view of the hydraulic control and actuation system, taken along line 4-4 of FIG. 3H.

The leads 92 from the position sensor 86 and leads 100 from the motor 98 extend through a passage 102 which is visible in part in FIG. 4. The passage 102 permits the leads 92, 100 to extend into another internal chamber 104 of the housing assembly 50. The chamber 104 is visible in cross-section in FIG. 5.

Figure 5:
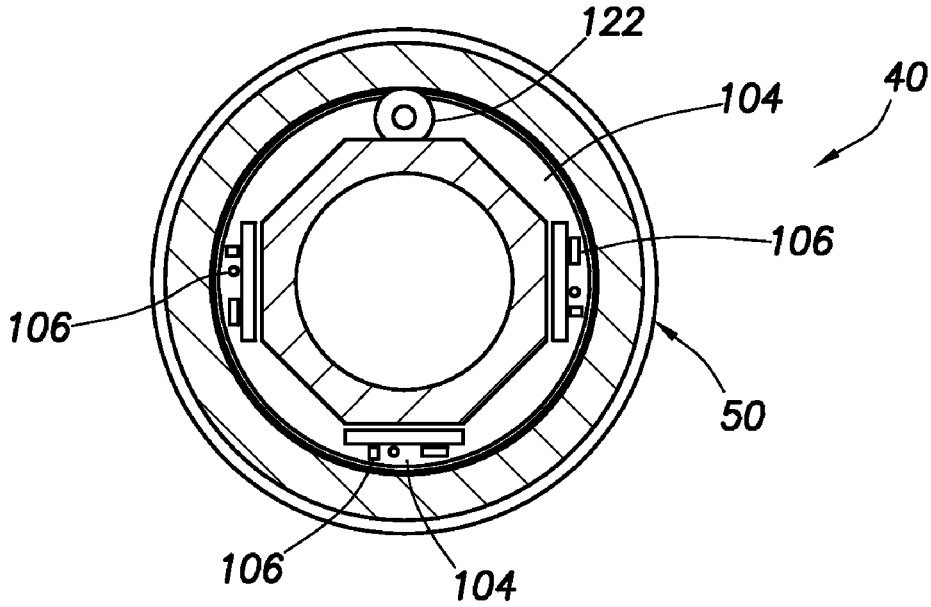
FIG. 5 is a cross-sectional view of the hydraulic control and actuation system, taken along line 4-4 of FIG. 3I.

It may be seen in FIG. 5 that the chamber 104 has electronic circuits 106 positioned therein. The electronic circuits 106 perform many functions in the system 40, including controlling operation of the valve assembly 42, receiving the outputs of the position sensor 86, the motor 98, the transducer 128, and controlling communications between the system 40 and a remote location, such as the earth's surface or another downhole location. Of course, many other functions may be performed by the circuits 106 in addition to, or instead of, the functions listed above, in keeping with the principles of the invention.

Preferably, the chamber 104 is isolated from well fluids by metal-to-metal seals 108. The seals 108 provide far greater durability and resistance to gas transmission therethrough as compared to elastomeric seals. However, it should be understood that any type of seals may be used for the chamber 104 without departing from the principles of the invention.

In addition, the circuits 106 are protected by being surrounded by an inert gas in the chamber 104. Preferably, the chamber 104 is evacuated of air after the circuits 106 are installed therein (e.g., by pulling a vacuum on the chamber), and then an inert gas, such as argon, is introduced into the chamber. This prevents components of the circuits 106 from reacting with oxygen, moisture, etc., in air at the elevated temperatures of a downhole environment. However, it should be understood that it is not necessary in keeping with the principles of the present invention for the circuits 106 to be surrounded by an inert gas in the chamber 104.

Figure 6:
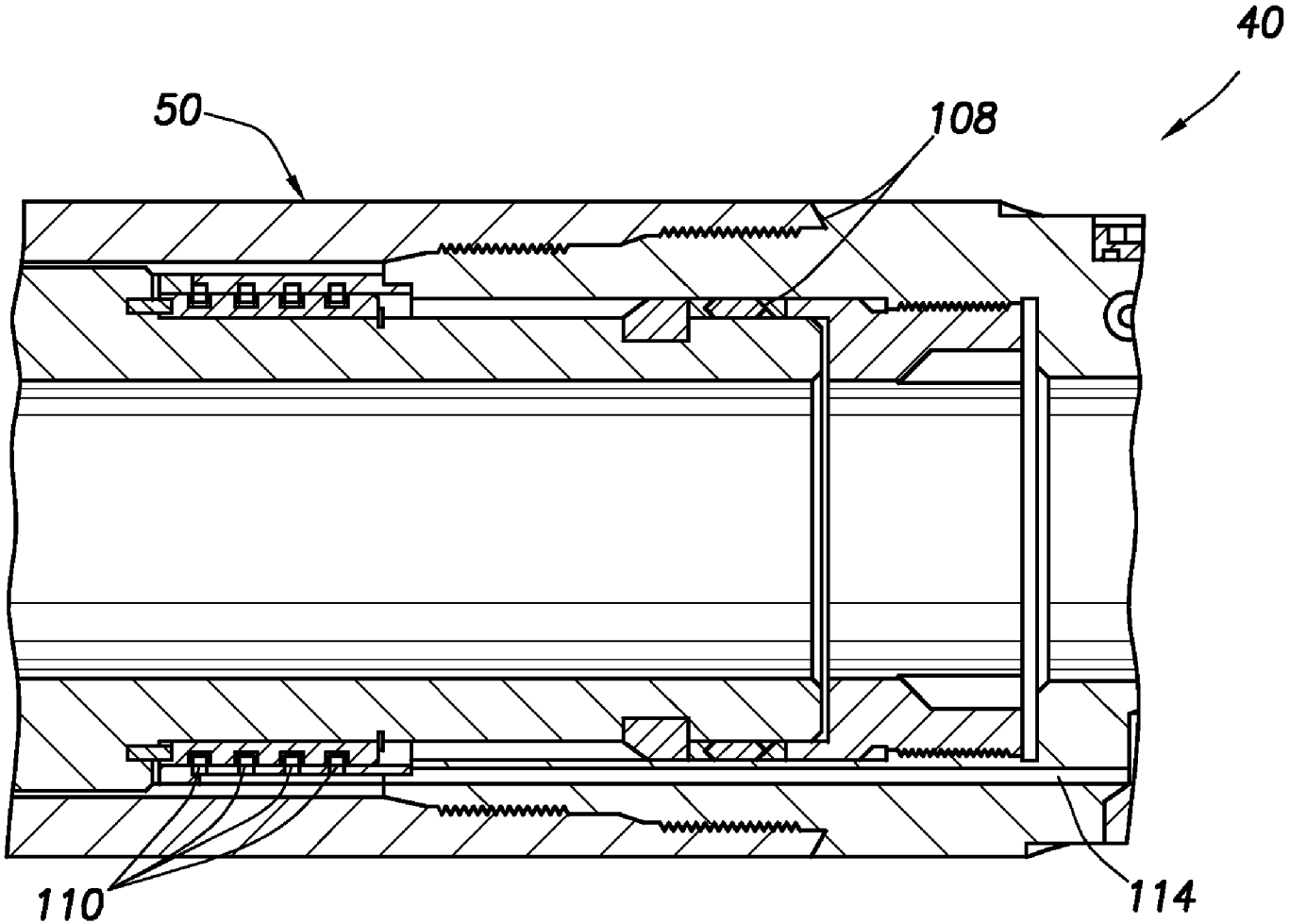
FIG. 6 is an enlarged cross-sectional view of a seal portion of the hydraulic control and actuation system illustrated in FIG. 3J.

An enlarged view of a lower end of the chamber 104 is illustrated in FIG. 6. In this view it may be seen how slip rings 110 are used to provide electrical communication between the chamber 104 and a lower battery chamber 112 via a passage 114 in the housing assembly 50. Batteries 116 in the chamber 112 supply electrical power to the circuits 106.

Below the battery chamber 112 is another chamber 118 containing a stack of piezoelectric crystal rings 120. When supplied with electric power from the circuits 106, the rings 120 deform, causing an impact within the housing assembly 50. Basically, the impact is transmitted through the housing assembly 50 as an acoustic wave. Such transmission of acoustic waves may be used to communicate with a remote location.

Preferably, the piezoelectric rings 120 are electrically actuated to transmit coded acoustic signals which travel through a tool string in which the system 40 is connected in a well. The acoustic signals are preferably detected by a repeater in the well and are retransmitted to a more distant location, such as the earth's surface. This technique of acoustic telemetry is known to those skilled in the art as "short hop-long hop" transmission. However, it should be clearly understood that any form of telemetry may be used for communication between the system 40 and a remote location in keeping with the principles of the invention. For example, hard wire communication (such as by wireline), electromagnetic telemetry, telemetry by manipulation of weight or torque applied to a tubular string in which the system 40 is interconnected, or pressure pulse telemetry could be used.

An accelerometer 122 is positioned in the chamber 104. The accelerometer 122 detects acoustic signals transmitted to the system 40 from a remote location. If the "short hop-long hop" technique of acoustic telemetry is used, the acoustic signals are transmitted from the remote location to a repeater in the well, and then the repeater retransmits the acoustic signals to the system 40, where the acoustic waves traveling through the housing assembly 50 are detected by the accelerometer 122. However, note that a repeater is not always required.

The accelerometer 122 is connected to the circuits 106, which decode the acoustic signals and store any data and/or respond to any commands contained in the signals. Thus, the system 40 is in two-way communication with the remote location. The system 40 can respond to instructions transmitted from the remote location, and the remote location can receive data acquired and transmitted by the system to the remote location.

The system 40 may also, or alternatively, be in two-way communication with a nearby location, decoding acoustic signals and storing any data therein. The system 40 may also, or alternatively, respond to data and instructions transmitted from a nearby location, and can transmit data and instructions to a nearby location.

Figure 7A:
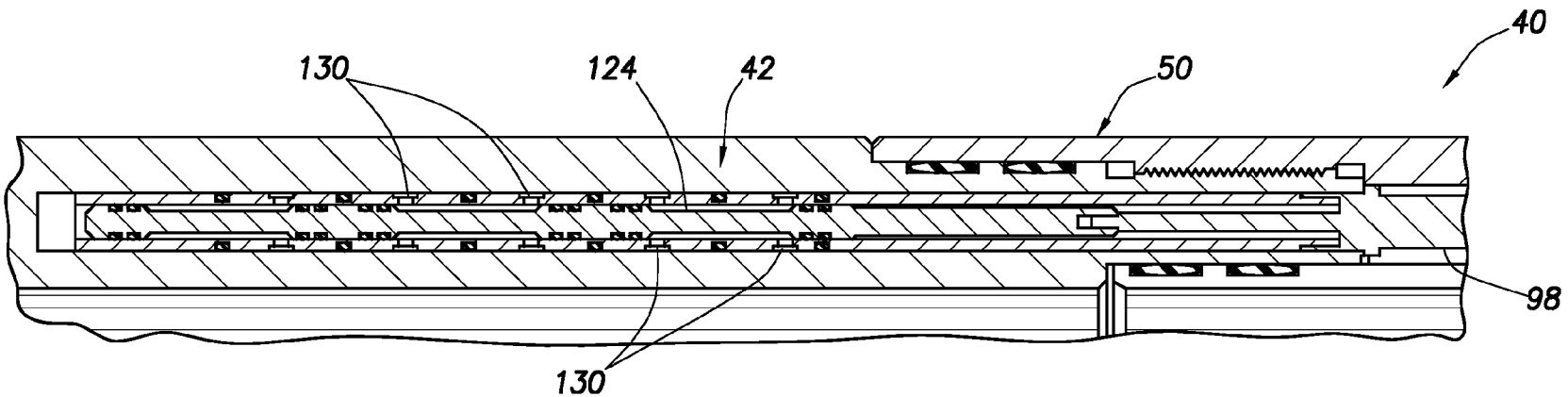
FIGS. 7A & B are enlarged cross-sectional views of a valve portion of the hydraulic control and actuation system illustrated in FIG. 3G.

Referring additionally now to FIGS. 7A & B, the valve assembly 42 is illustrated at an enlarged scale. In these views it may be seen that the valve assembly 42 is very similar to the valve assembly 12 described above, in that a valve member or shuttle 124 is displaced to alternately apply pressure from the energy source and connect the low pressure region (the annulus 44 and the chamber 46) to opposite sides 78, 80 of the piston 62. Ports 130 are for admitting fluid pressure from the annulus 44 to the valve assembly 42, transferring fluid from the valve assembly to the chamber 46, and directing fluid to and from the piston 62 via passages, such as passages 54, 60 described above, but not visible in FIGS. 7A & B.

Figure 7B:
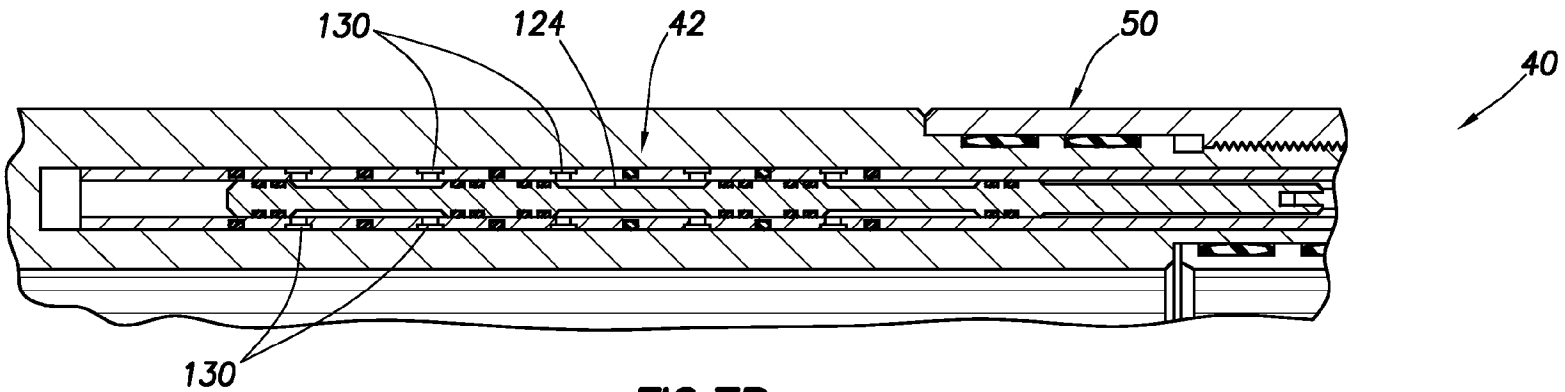

In FIG. 7A, the shuttle 124 is depicted in its leftmost position, and in FIG. 7B, the shuttle 124 is depicted in its rightmost position. The shuttle 124 is displaced between these positions by the motor 98.

In FIGS. 8A-L, the system 40 is depicted after the shuttle 124 has been displaced from its FIG. 7A position to its FIG. 7B position. Pressure from the annulus 44 has, thus, been directed to the lower side 78 of the piston 62, and the chamber 46 has been connected to the upper side 80 of the piston.

The outer sleeve 64 has displaced upward, biased by the pressure differential between the annulus 44 and the chamber 46, and now contacts the shoulder 82. The inner mandrel 70 continues to displace upward, however, and the piston 62 now has a reduced effective piston area.

In FIGS. 9A-L, the system 40 is depicted in cross-section, but the cross-section is rotated somewhat from the cross-sections shown in FIGS. 3A-L and FIGS. 8A-L, so the valve assembly 42 is not visible. The system 40 is shown in FIGS. 9A-L after the inner mandrel 70 has been displaced upward as far as it can in the bore 72 of the outer sleeve 64. Thus, the actuator assembly 48 has displaced the mandrel 84 to its full upward extent, transferring fluid from the upper side 80 of the piston 62 to the chamber 46. The mandrel 84 may be displaced downward by activating the motor 98 to displace the shuttle 124 upward again to its FIG. 7A position (to the left as viewed in FIG. 7A).

Such upward displacement of the shuttle 124 will cause pressure from the annulus 44 to be directed to the upper side 80 of the piston 62, and pressure from the chamber 46 to be directed to the lower side 78 of the piston. The piston 62 will displace downward (with an effective piston area which decreases during the piston's downward displacement), transferring fluid from the lower side 78 of the piston to the chamber 46.

Therefore, it may now be fully appreciated that the system 40 provides a convenient means of actuating the well tool 26 by upward and downward displacement of the mandrel 84. The system 40 is in communication with a remote location, so that actuation of the tool 26 may be remotely controlled and monitored. The status and performance of the system 40 may also be monitored at the remote location.

Figure 10:
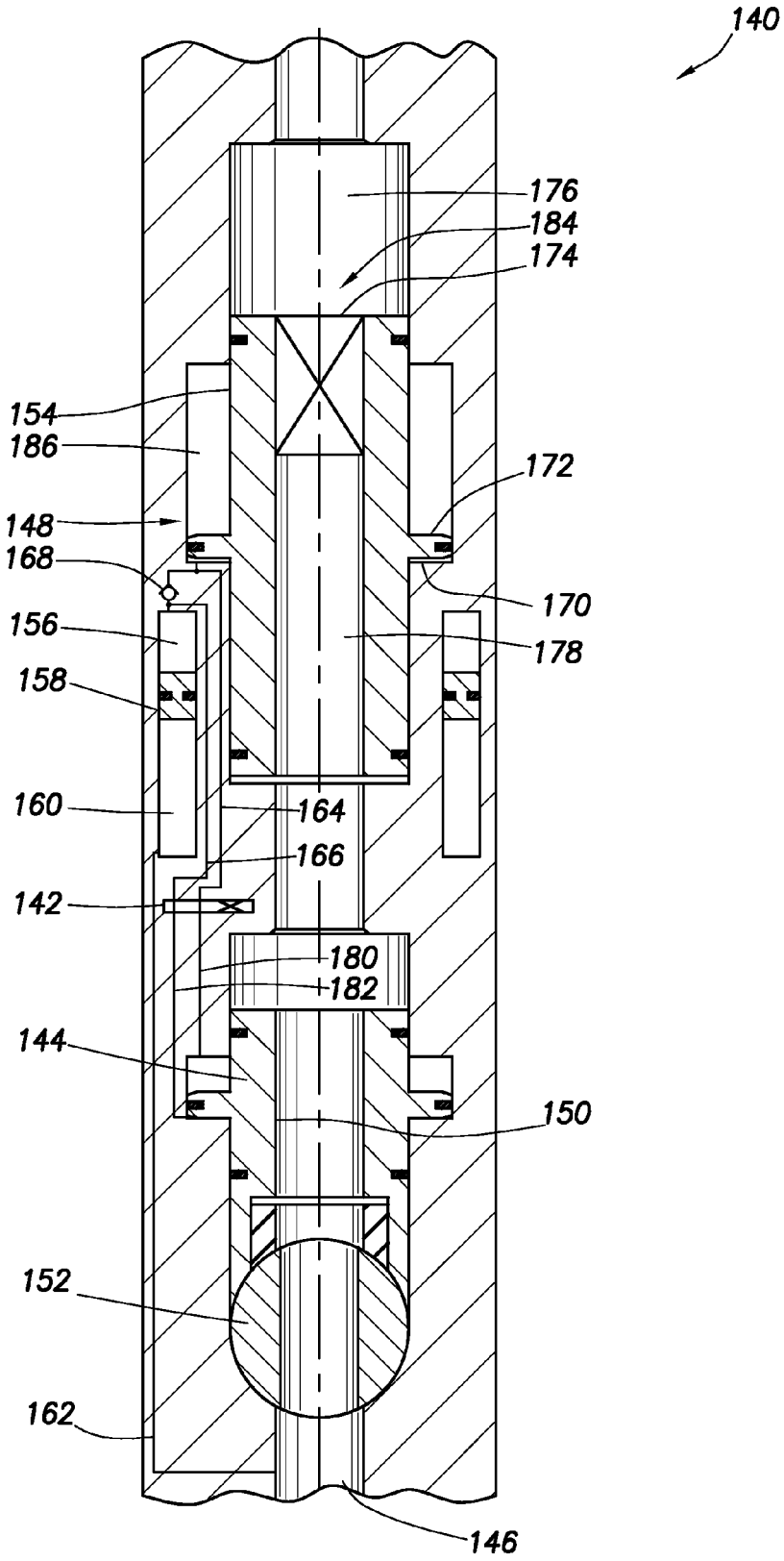
FIG. 10 is a schematic cross-sectional view of another hydraulic control and actuation system embodying principles of the present invention.

Referring additionally now to FIG. 10, another embodiment of a hydraulic control and actuation system 140 is representatively illustrated. The system 140 is similar in many respects to the system 40 described above, in that it includes a valve assembly 142 (schematically depicted in FIG. 10, but similar to the valve assembly 12 or 42 described above) which controls communication between an actuator assembly 144 and each of an energy source 146 and a low pressure region 148.

The actuator assembly 144 includes an operating mandrel or piston 150 which is displaced in one direction to open a ball valve 152, as depicted in FIG. 10, and which is displaced in an opposite direction to close the ball valve. The energy source 146 is preferably, although not necessarily, pressure in a tubular string below the ball valve 152.

The low pressure region 148 preferably, although not necessarily, includes a chamber 186 internal to the housing assembly 50. As depicted in FIG. 10, the chamber 186 is an air chamber. A piston 154 is used to separate the chamber 186 from fluid transmitted thereto from a fluid filled chamber 156.

A floating piston 158 separates the chamber 156 from another chamber 160, which is in communication with the energy source 146 via a passage 162. Thus, pressure in the energy source 146 is transmitted via the passage 162 to the chamber 160, and the floating piston 158 acts to transmit the pressure to the chamber 156, which is in communication with the valve assembly 142 via passages 164, 166. A check valve 168 permits flow only from the chamber 156 to the valve assembly 142 through the passage 164 during normal operation of the system 140.

Fluid and pressure in the energy source 146 may flow through the passage 162 to the chamber 160, where it acts on a lower side of the piston 158. The piston 158 isolates this fluid from clean fluid, preferably hydraulic oil, in the chamber 156 above the piston. This clean fluid may flow through the check valve 168 and passage 164 to the valve assembly 142.

As with the other valve assemblies 10, 40 described above, the valve assembly 142 controls application of the pressures of the energy source 146 and low pressure region 148 to alternate sides of the piston 150. Passages 180, 182 provide for communication between the valve assembly 142 and opposite sides of the piston 150. However, in a unique feature of the system 140, the piston 154 permits the system 140 to be "recocked" so that there is no limit to the number of times that the valve assembly 142 can apply the pressures to the piston 150.

It will be readily appreciated that each time the piston 150 is stroked, a volume of the fluid in the chamber 156 is admitted to a chamber 170 below a radially enlarged portion 172 of the piston 154. The radially enlarged portion 172 separates the chamber 186 from the fluid in the chamber 170. The system 140 may be operated, alternately opening and closing the ball valve 152, until the chamber 170 can no longer accept any more fluid from the chamber 156 via the valve assembly 142, or until there is no more fluid in the chamber 156 to transfer to the chamber 170.

At this point, a plug 174 may be set in the piston 154 (for example, conveyed by wireline) to isolate an upper portion 176 of a tubular string interior passage in which the system 140 is interconnected from a lower portion 178 of the passage. Pressure may then be applied to the upper portion 176 to thereby displace the piston 154 downwardly. The piston 154 displaces downwardly due to the pressure differential between the portions 176, 178 of the tubular string passage.

As the piston 154 displaces downwardly, the valve assembly 142 is positioned such that the chamber 170 is in communication with the chamber 156 via the passages 164, 166. Thus, downward displacement of the piston 154 causes the fluid in the chamber 170 to be transferred back into the chamber 156. This operation "recocks" the system 140, so that additional displacements of the piston 150 may be performed.

The plug 174 may be retrieved from the piston 154 when the recocking operation is completed. Together, the piston 154 and the plug 174 make up a recocking device 184 which reverses the flow of fluid from the low pressure region 148 back to the energy source 146.

Note that it is not necessary to recock a system embodying principles of the invention using a pressure differential between portions of a tubular string. For example, another type of actuator may be used as a recocking device to displace the piston 154 downwardly. An example of such an actuator is found in the OMNI valve, commercially available from Halliburton Energy Services, Inc. of Houston, Tex.

The OMNI valve actuator operates upon application of annulus pressure, rather than tubing pressure. If used in the system 140, the OMNI valve actuator would preferably apply a force directly to the piston 154 to displace the piston downwardly.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A hydraulic control and actuation system for a downhole tool, comprising:

a housing assembly;

an actuator assembly including a piston positioned within the housing assembly, the tool operating in response to displacement of the piston relative to the housing assembly;

a valve assembly which provides fluid communication between the piston and each of an energy source and a low pressure region; and a recocking device which transfers fluid from the low pressure region to the energy source while the hydraulic control and actuation system is positioned within a wellbore.

2. The system according to claim 1, wherein the valve assembly admits fluid from the energy source into the actuator assembly when the piston displaces in each of a first direction and a second direction opposite to the first direction, and wherein the valve assembly permits the fluid to flow from the actuator assembly to the low pressure region when the piston displaces in each of the first and second directions.

3. The system according to claim 2, wherein pressure in the low pressure region increases when the piston displaces in each of the first and second directions.

4. The system according to claim 1, wherein the energy source is an annulus external to the housing assembly.

5. The system according to claim 1, wherein the energy source includes a biasing device.

6. The system according to claim 1, wherein the energy source includes a compressed gas.

7. The system according to claim 1, wherein the energy source includes a battery.

8. The system according to claim 1, wherein the low pressure region is an internal chamber in the housing assembly.

9. The system according to claim 1, further comprising a pressure switch which is actuated when pressure in the low pressure region reaches a predetermined level.

10. The system according to claim 1, wherein the valve assembly is controlled by an electronic circuit within the housing assembly.

11. The system according to claim 10, wherein the electronic circuit is isolated from well fluids by at least one metal-to-metal seal.

12. The system according to claim 1, wherein operation of the valve assembly is controlled by telemetry transmitted from a remote location.

13. The system according to claim 12, wherein the telemetry is selected from the group consisting of electromagnetic telemetry, acoustic telemetry, pressure pulse telemetry and telemetry by manipulation of weight or torque applied to a tubular string in which the system is interconnected, and combinations of these forms of telemetry.

14. The system according to claim 1, wherein operation of the valve assembly is controlled from a remote location via hard wire.

15. The system according to claim 1, wherein data transmission to a remote location is provided by telemetry.

16. The system according to claim 15, wherein the telemetry is selected from the group consisting of electromagnetic telemetry, acoustic telemetry, pressure pulse telemetry and telemetry by manipulation of weight or torque applied to a tubular string in which the system is interconnected, and combinations of these forms of telemetry.

17. The system according to claim 1, wherein data is transmitted to a remote location via hard wire.

18. The system according to claim 1, wherein a position of the tool is transmitted to a remote location by telemetry.

19. The system according to claim 18, wherein the telemetry is selected from the group consisting of electromagnetic telemetry, acoustic telemetry, pressure pulse telemetry and telemetry by manipulation of weight or torque applied to a tubular string in which the system is interconnected, and combinations of these forms of telemetry.

20. The system according to claim 1, wherein a position of the tool is transmitted to a remote location via hard wire.

21. The system according to claim 1, wherein a position of the piston is transmitted to a remote location by telemetry.

22. The system according to claim 21, wherein the telemetry is selected from the group consisting of electromagnetic telemetry, acoustic telemetry, pressure pulse telemetry and telemetry by manipulation of weight or torque applied to a tubular string in which the system is interconnected, and combinations of these forms of telemetry.

23. The system according to claim 1, wherein a position of the piston is transmitted to a remote location via hard wire.

24. The system according to claim 1, further comprising an electro-mechanical device which is operable to displace a valve member between the first and second positions.

25. The system according to claim 1, further comprising a displacement sensor which detects displacement of a valve member.

* * * * *